US012663168B2

(12) United States Patent
Zhang et al.

(10) Patent No.: US 12,663,168 B2
(45) Date of Patent: Jun. 23, 2026

(54) DEHUMIDIFIER

(71) Applicant: GD MIDEA AIR-CONDITIONING EQUIPMENT CO., LTD., Foshan (CN)

(72) Inventors: Zhiming Zhang, Foshan (CN); Tianhong Zhu, Foshan (CN); Fashen Liu, Foshan (CN)

(73) Assignee: GD MIDEA AIR-CONDITIONING EQUIPMENT CO., LTD., Foshan (CN)

( * ) Notice: Subject to any disclaimer, the term of this patent is extended or adjusted under 35 U.S.C. 154(b) by 188 days.

(21) Appl. No.: 18/686,856

(22) PCT Filed: Oct. 29, 2021

(86) PCT No.: PCT/CN2021/127612
§ 371 (c)(1),
(2) Date: Feb. 26, 2024

(87) PCT Pub. No.: WO2023/024255
PCT Pub. Date: Mar. 2, 2023

(65) Prior Publication Data

US 2025/0129949 A1 Apr. 24, 2025

(30) Foreign Application Priority Data

Aug. 27, 2021 (CN) ..... 202111000910.6
Aug. 27, 2021 (CN) ..... 202122053125.9

(51) Int. Cl.
*F24F 1/0358* (2019.01)
*F24F 13/22* (2006.01)

(52) U.S. Cl.
CPC ..... *F24F 1/0358* (2019.02); *F24F 13/222* (2013.01)

(58) Field of Classification Search
CPC .. F24F 1/0358; F24F 13/222; F24F 2003/144; F24F 3/1405; F24F 2003/1446; F24F 3/14
See application file for complete search history.

(56) References Cited

U.S. PATENT DOCUMENTS

2015/0090350 A1 4/2015 Chiu
2015/0184875 A1* 7/2015 Lee ..... F24F 3/1405 62/93

(Continued)

FOREIGN PATENT DOCUMENTS

CN 201956275 U 8/2011
CN 204084737 U 1/2015

(Continued)

OTHER PUBLICATIONS

KR 102198138 B1 Translation (Year: 2021).*

(Continued)

*Primary Examiner* — Jerry-Daryl Fletcher
*Assistant Examiner* — Dario Antonio Deleon
(74) *Attorney, Agent, or Firm* — Anova Law Group, PLLC

(57) ABSTRACT

A dehumidifier includes a middle partition plate, a water tank provided at one side of the middle partition plate, a mounting bracket including a fixation structure provided at an outer surface of the mounting bracket, a liquid level detector provided at the mounting bracket, and a water pump assembly including a suction pipe provided at the fixation structure. A water inlet end of the suction pipe being provided at a bottom of the water tank.

17 Claims, 16 Drawing Sheets

(56) References Cited

U.S. PATENT DOCUMENTS

| | | | | |
|---|---|---|---|---|
| 2019/0024915 | A1* | 1/2019 | Cai | F24F 6/12 |
| 2021/0172628 | A1* | 6/2021 | Park et al. | F24F 6/16 |

FOREIGN PATENT DOCUMENTS

| | | | | | |
|---|---|---|---|---|---|
| CN | 108050602 | A | | 5/2018 | |
| CN | 208487768 | U | * | 2/2019 | F24F 3/14 |
| CN | 209639158 | U | * | 11/2019 | F24F 6/12 |
| CN | 210004566 | U | | 1/2020 | |
| CN | 112082241 | A | * | 12/2020 | F24F 6/12 |
| CN | 213180220 | U | | 5/2021 | |
| CN | 215637676 | U | | 1/2022 | |
| CN | 215808946 | U | | 2/2022 | |
| JP | 2010046639 | A | | 3/2010 | |
| JP | 2013226484 | A | | 11/2013 | |
| KR | 102198138 | B1 | * | 1/2021 | F24F 3/14 |

OTHER PUBLICATIONS

CN 112082241 A Translation (Year: 2020).*
CN 209639158 U Translation (Year: 2019).*
CN 208487768 U Translation (Year: 2019).*
The World Intellectual Property Organization (WIPO) International Search Report and Written Opinion for PCT/CN2021/127612 May 30, 2022 18 Pages (including translation).
The European Patent Office (EPO) the Extended European Search Report for Application No. 21954775.9 Dec. 12, 2024 8 Pages.
China National Intellectual Property Administration (CNIPA) Office Action 1 for Application No. 202111000910.6 Dec. 4, 2024 20 Pages (including translation).

* cited by examiner

DEHUMIDIFIER

CROSS-REFERENCE TO RELATED APPLICATIONS

This application is a National Stage Entry under 35 U.S.C. § 371 of International Application No. PCT/CN2021/127612, filed on Oct. 29, 2021, which claims priority to Chinese Patent Application No. 202111000910.6, filed on Aug. 27, 2021, and Chinese Patent application Ser. No. 20/212,2053125.9, filed on Aug. 27, 2021, the entire contents of all of which are incorporated herein by reference.

TECHNICAL FIELD

The present application relates to the field of dehumidification technology, in particular to a dehumidifier.

BACKGROUND

With the improvement of people's living standards, people have higher and higher requirements for indoor living environment. In order to prevent the humidity in indoor air from being too high, dehumidifiers are usually used to reduce the air humidity. In the related art, the water tank is usually provided inside the dehumidifier, when provided in this way, the size of the water tank is limited, which results in the water tank having a small volume and being easily filled up with water. During the dehumidification process, the user needs to pour water more frequently, which affects the user experience.

SUMMARY

The main purpose of the present application is to propose a dehumidifier designed to facilitate water tank drainage to reduce the number of times the user pours water.

In order to achieve the above purpose, the dehumidifier proposed in the present application includes:

- a middle partition plate;
- a water tank provided at one side of the middle partition plate;
- a mounting bracket, wherein an outer surface of the mounting bracket is provided with a fixation structure;
- a liquid level detector provided at the mounting bracket; and
- a water pump assembly including a suction pipe provided at the fixation structure, and a water inlet end of the suction pipe is provided at a bottom of the water tank.

In an embodiment, the fixation structure includes a connection part and a shield part, the connection part is connected to the outer surface of the mounting bracket, the shield part is connected to the connection part and is spaced apart from the outer surface of the mounting bracket, and the suction pipe is clamped between the shield part and the outer surface of the mounting bracket.

In an embodiment, the dehumidifier further includes a filter bracket, the filter bracket is provided with a filter cavity and a water filter joint communicating with the filter cavity, and a lower end of the suction pipe is connected to the water filter joint.

In an embodiment, the fixation structure is integrally formed with the mounting bracket.

In an embodiment, the mounting bracket is provided with an accommodation cavity and a water inlet communicating with the accommodation cavity, the water inlet is provided at a bottom of the mounting bracket, the liquid level detector includes a floater part, a trigger part and a detection switch, the floater part is movably provided at the accommodation cavity, the trigger part is connected to the floater part, and the detection switch is provided above the trigger part and configured to trigger the detection switch.

In an embodiment, the floater part is provided with a floater cavity and an opening communicating with the floater cavity, and the opening is provided at a bottom of the floater part.

In an embodiment, one of the floater part and a cavity wall of the accommodation cavity is provided with a sliding convex rib slidingly abutted against the other of the floater part and the cavity wall of the accommodation cavity, and the sliding convex rib is configured to extend along an up and down direction.

In an embodiment, the mounting bracket is further provided with a positioning hole communicating with the accommodation cavity, the trigger part includes a connection rod part and a trigger member, the connection rod part is connected to the floater part, the trigger member is provided at an upper end of the connection rod part, and the connection rod part is slidingly provided in the positioning hole.

In an embodiment, the water pump assembly further includes a first joint and a second joint, the second joint is provided at the middle partition plate, the first joint is provided at the mounting bracket, one end of the first joint is connected to the suction pipe, and another end of the first joint is in insertion connection with the second joint.

In an embodiment, the dehumidifier further includes a housing, the middle partition plate is provided in the housing, the housing is provided with a water tank assembly port for disassembling and assembling the water tank, and the second joint is provided toward the water tank assembly port.

In an embodiment, a sealing member is provided between the first joint and the second joint.

In an embodiment, the second joint is sleeved on an outside of the first joint, a sealing groove is provided at an inside of the second joint or an outside of the first joint, the sealing member is limited to the sealing groove, and the sealing member partially protrudes outside the sealing groove; or the first joint is sleeved on an outside of the second joint, a sealing groove is provided at an inside of the first joint or an outside of the second joint, the sealing member is limited to the sealing groove, and the sealing member partially protrudes outside the sealing groove.

In an embodiment, the middle partition plate includes a support plate and a mounting plate connected to an upper end of the support plate, the water tank is provided at one side of the support plate, the mounting plate is provided above the water tank, the mounting plate is provided with a mounting through hole, and the second joint is provided at the mounting through hole.

In an embodiment, the middle partition plate further includes a fixation bracket, the fixation bracket is provided at the mounting through hole, and the second joint is provided at the fixation bracket.

In an embodiment, the water pump assembly further includes a water pump, the water pump is provided at the mounting plate, and a water inlet end of the water pump is configured to communicate with the second joint.

In an embodiment, the water pump assembly further includes a drainage joint and a drainage pipe, one end of the drainage joint communicates with the suction pipe, another end of the drainage joint is for the drainage pipe to be inserted in, one end of the drainage pipe inserted in the drainage joint is provided with a mark part, and the mark part is configured to mark an insertion depth of the drainage pipe and the drainage joint.

In an embodiment, the dehumidifier further includes a water tank cover, the water tank cover is connected to an upper end of the mounting bracket, and the water tank cover is configured to cover an opening of the water tank.

The technical solution of the present application is to provide a mounting bracket, a liquid level detector and a water pump assembly on the dehumidifier, and install the liquid level detector and the suction pipe of the water pump assembly at the mounting bracket, thus making the water inlet end of the suction pipe be provided at the bottom of the water tank. In this way, the water level in the water tank can be detected by the liquid level detector, and then the water pump assembly can be started or shut down according to the water level in the water tank, thus using the water pump assembly to automatically drain the water in the water tank, which greatly facilitates the drainage of the water tank, avoids the need for users to pour water more frequently during the dehumidification process, and reduces the number of times the user pours water. Compared with the method where the suction pipe and the liquid level detector each have an mounting rack, in this solution, the liquid level detector and the suction pipe of the water pump assembly are both provided at the mounting bracket, which can reduce the number of parts of the dehumidifier and improve the compact structure of the dehumidifier. Moreover, the liquid level detector can be configured to determine that there is water in the water tank before starting the water pump assembly, which can prevent the water pump assembly from being started when there is no water or too much water in the water tank, which is beneficial to extending the life of the water pump assembly.

BRIEF DESCRIPTION OF THE DRAWINGS

In order to explain the embodiments of the present application or the technical solutions in the existing technology more clearly, the accompanying drawings needed to be used in the description of the embodiments or the existing technology will be briefly introduced below. Obviously, the accompanying drawings in the following description are only some embodiments of the present application, other accompanying drawings can be obtained based on the provided accompanying drawings without exerting creative efforts for those of ordinary skill in the art.

EXPLANATION OF REFERENCE NUMBERS

Figure 1:
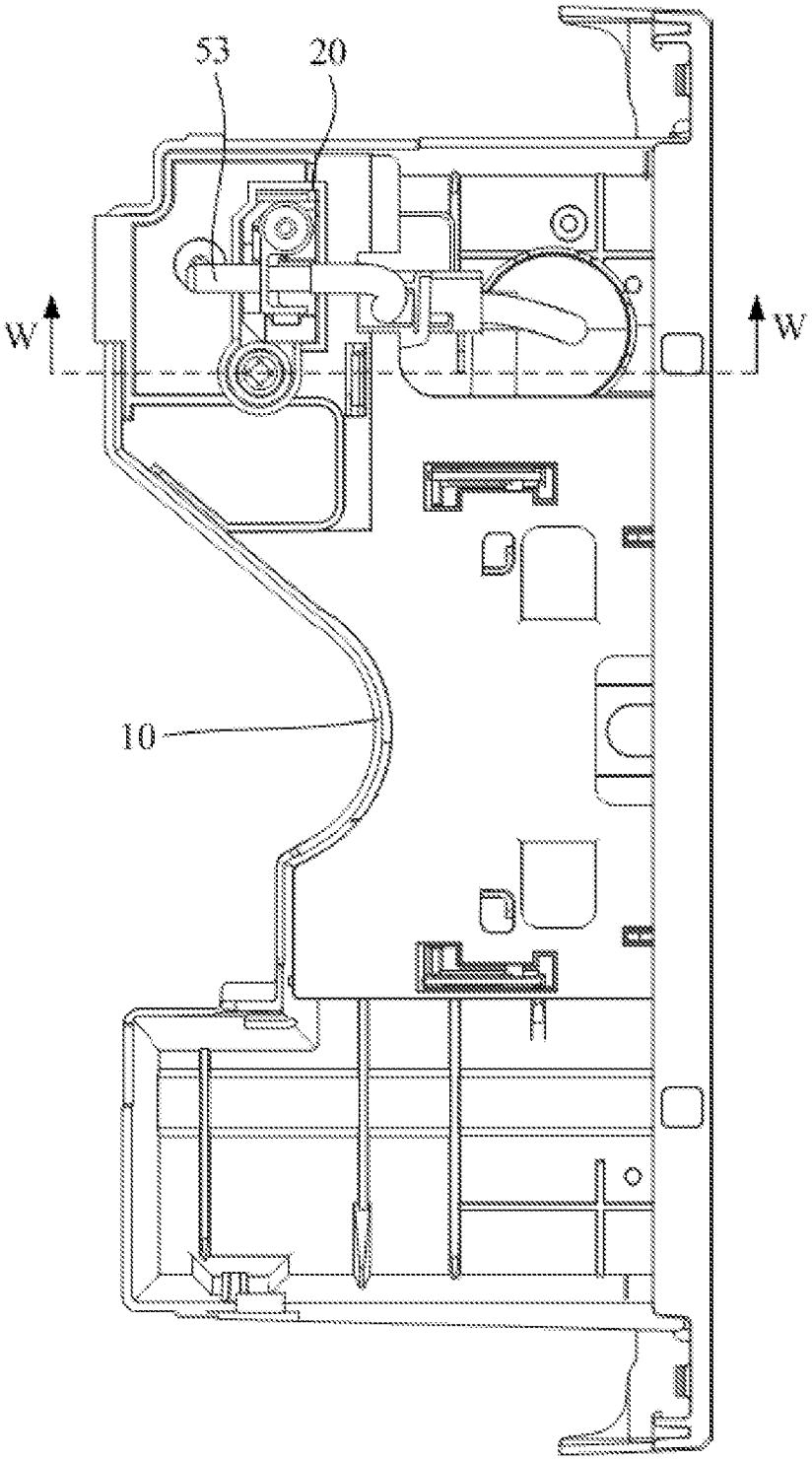
FIG. 1 is a schematic structural diagram of a water tank and a mounting bracket of a dehumidifier viewed from top to bottom according to an embodiment of the present application.

| number | name | number | name |
|---|---|---|---|
| 10 | water tank | 341 | snap |
| 20 | mounting bracket | 40 | liquid level detector |
| 201 | accommodation cavity | 41 | floater part |
| 202 | water inlet | 411 | floater cavity |
| 203 | limit hole | 412 | opening |
| 204 | positioning hole | 413 | sliding convex rib |
| 205 | first mounting section | 414 | limit protrusion |
| 206 | second mounting section | 42 | trigger part |
| 21 | water tank cover | 421 | connection rod part |
| 22 | fixation structure | 422 | positioning column |
| 221 | connection part | 423 | connection plate |
| 222 | shield part | 424 | trigger member |
| 223 | transition section | 43 | detection switch |
| 224 | limiting convex rib | 51 | suction pipe |
| 23 | filter bracket | 52 | water pump |
| 231 | water filter joint | 53 | first joint |
| 24 | filter cover | 54 | second joint |
| 241 | filter water inlet | 541 | sealing groove |
| 30 | middle partition plate | 55 | drainage joint |
| 31 | support plate | 56 | drainage pipe |
| 32 | water receiving tray | 561 | mark part |
| 33 | mounting plate | 60 | sealing member |
| 331 | mounting through hole | 70 | anti-falling member |
| 332 | fixation clip | 57 | first connection pipe |
| 34 | fixation bracket | 58 | second connection pipe |

The realization of the purpose, functional features and advantages of the present application will be further described in conjunction with the embodiments and with reference to the accompanying drawings.

DETAILED DESCRIPTION OF THE EMBODIMENTS

The technical solutions in the embodiments according to the present application will be clearly and completely described below in conjunction with the accompanying drawings in the embodiments according to the present application, and it is clear that the described embodiments are only a part of the embodiments according to the present application, and not all of the embodiments. Based on the embodiments in the present application, all other embodiments obtained by those of ordinary skill in the art without making creative labor fall within the scope of the present application.

It should be noted that, if there are directional instructions (such as up, down, left, right, front, back or the like) involved in the embodiments of the present application, the directional indications are only used to explain the relative positional relationship, movement and so on between various components in a specific posture (as shown in the accompanying drawings). If the specific posture changes, the directional indication will also change accordingly.

In addition, if there are descriptions involving "first," "second" or the like in the present application, the descriptions of "first," "second" or the like are only for descriptive purposes and cannot be understood as indicating or implying the relative importance or implicitly indicating the quantity of the technical features indicated. Therefore, features defined as "first" and "second" may explicitly or implicitly include at least one of these features. In addition, the meaning of "and/or" appearing in the entire text includes three parallel solutions, taking "A and/or B" as an example, it includes solution A, or solution B, or a solution that satisfies both A and B at the same time. In addition, the technical solutions of various embodiments can be combined with each other, but it must be based on that those of ordinary skill in the art can realize. When the combination of technical solutions is contradictory or cannot be realized, it should be considered that such combination of technical solutions does not exist and is not within the protection scope claimed by the present application.

The present application proposes a dehumidifier.

Figure 2:
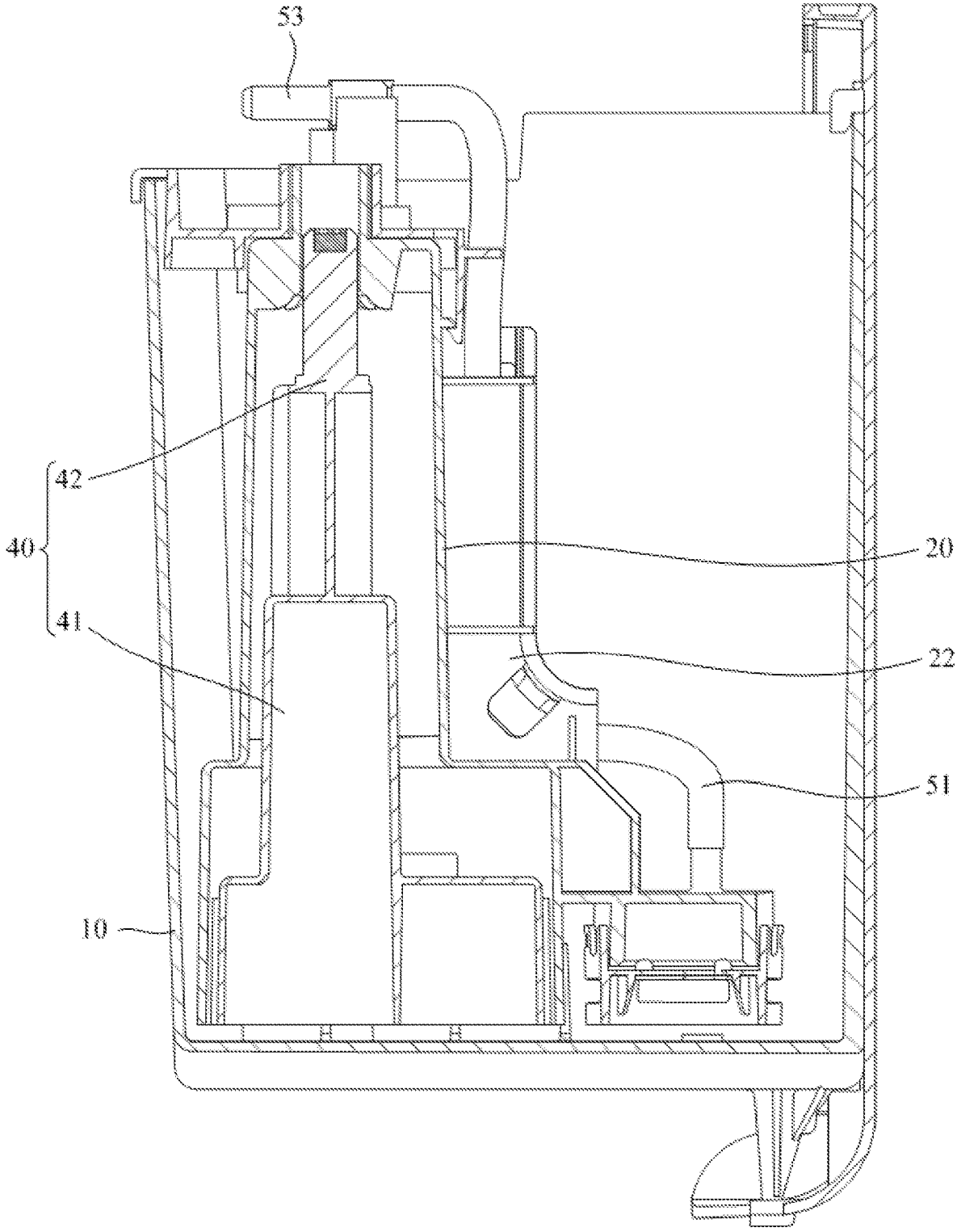
FIG. 2 is a cross-sectional view at W-W in FIG. 1.
Figure 3:
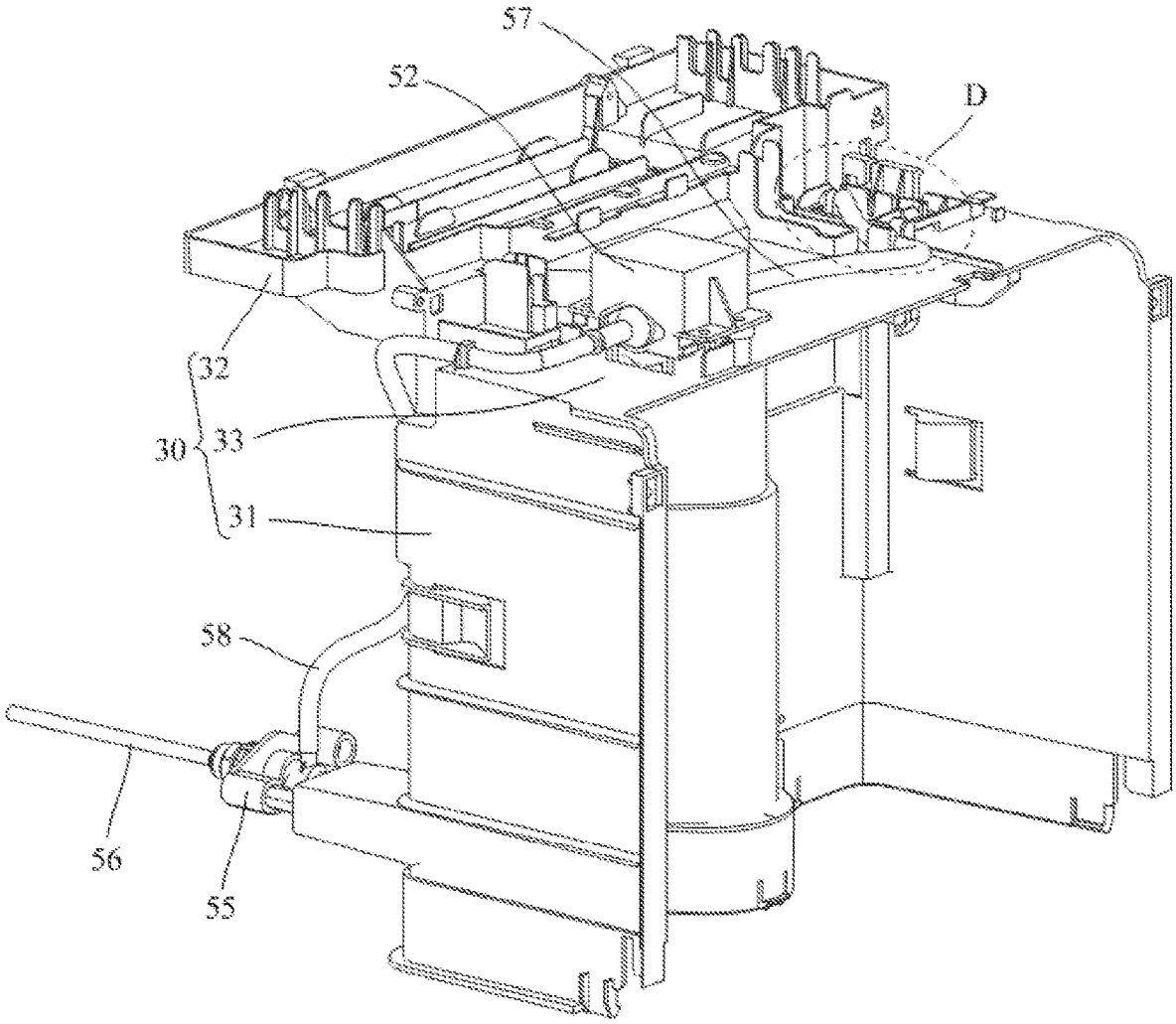
FIG. 3 is a schematic structural diagram of a water pump assembly and a middle partition of a dehumidifier according to an embodiment of the present application.
Figure 4:
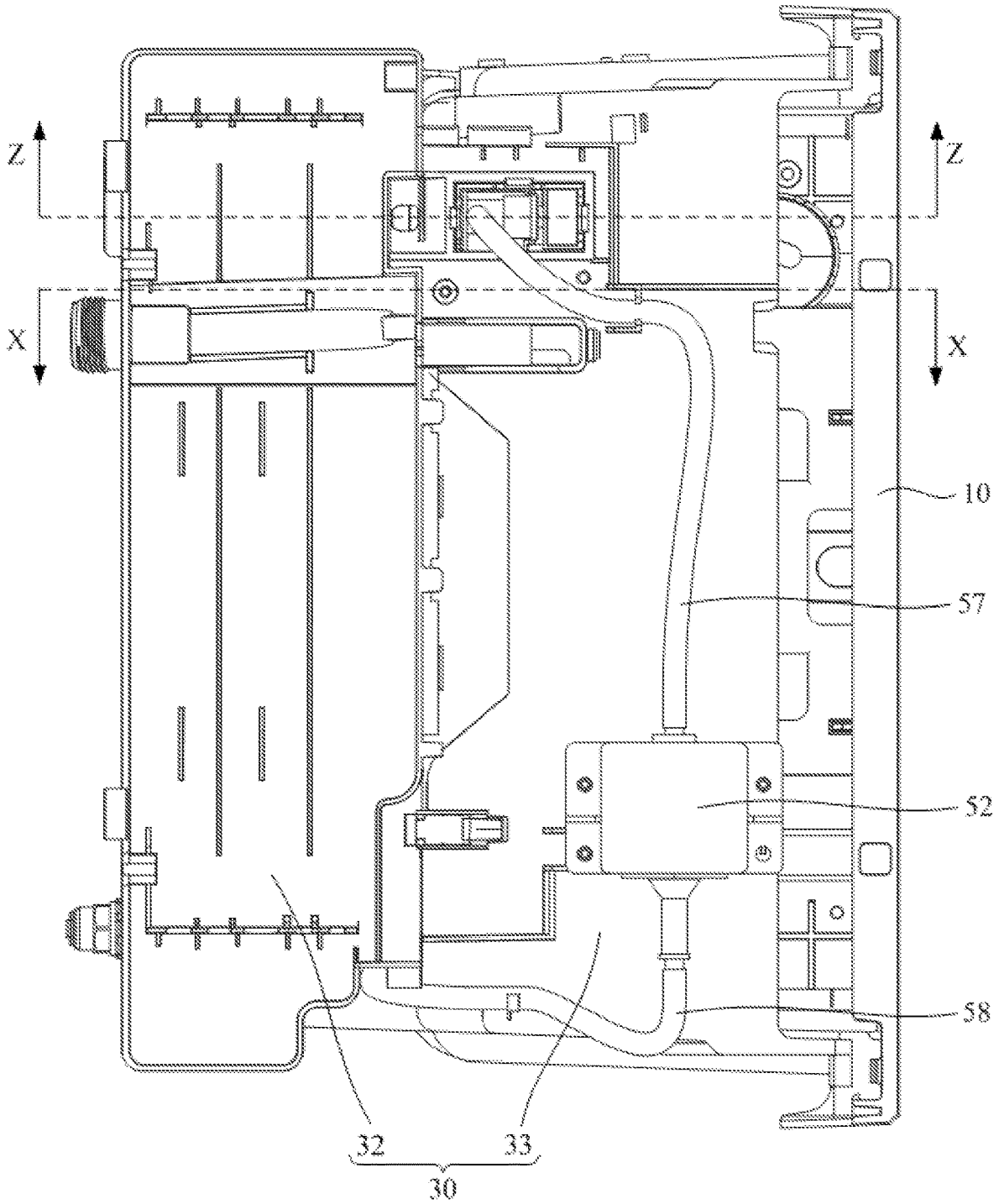
FIG. 4 is a schematic structural diagram of a middle partition plate and a water tank assembled together and viewed from top to bottom according to an embodiment of a dehumidifier of the present application.
Figure 5:
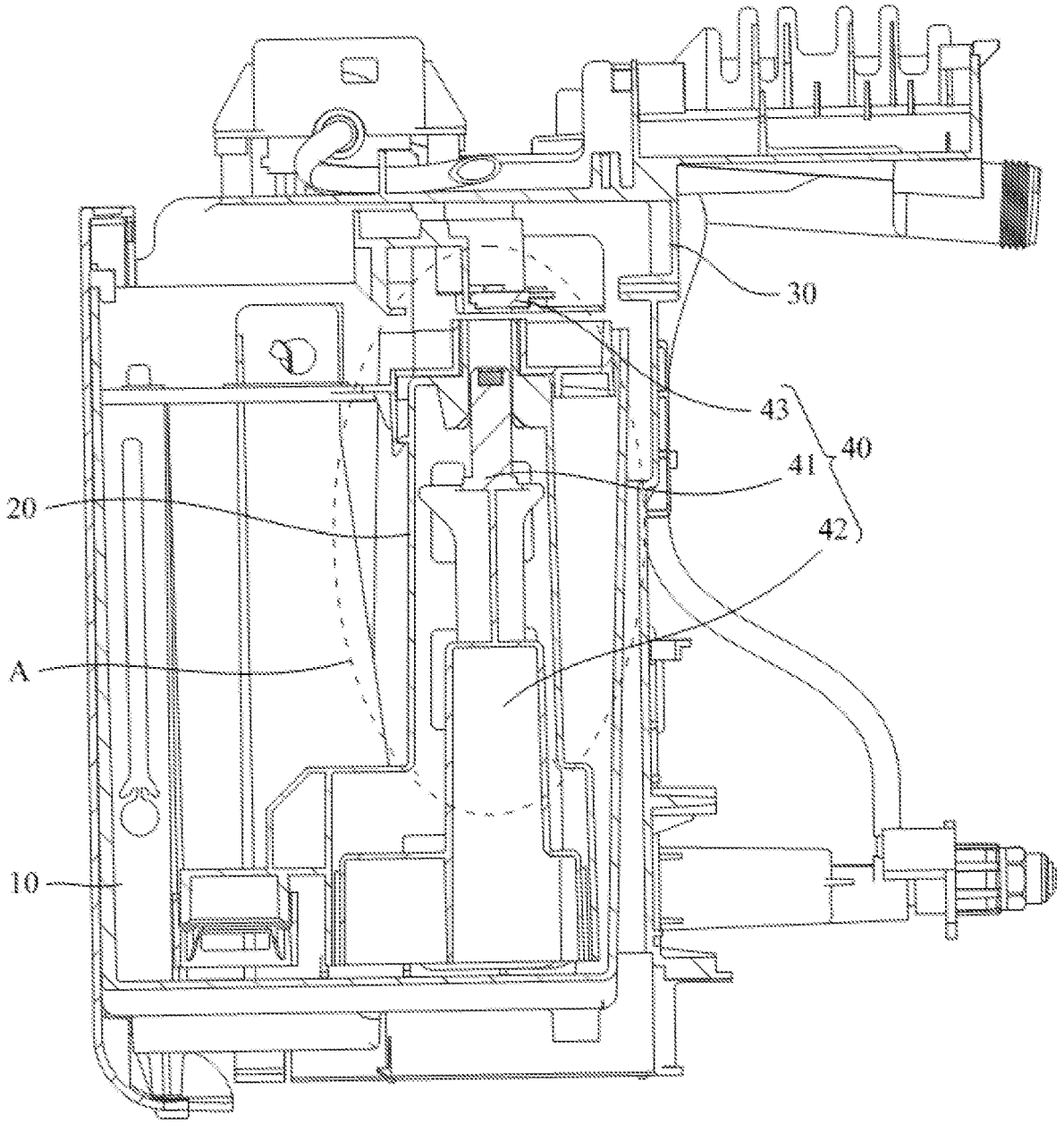
FIG. 5 is a schematic structural diagram of the cross-sectional view at X-X in FIG. 4 after rotating 180° counterclockwise.
Figure 6:
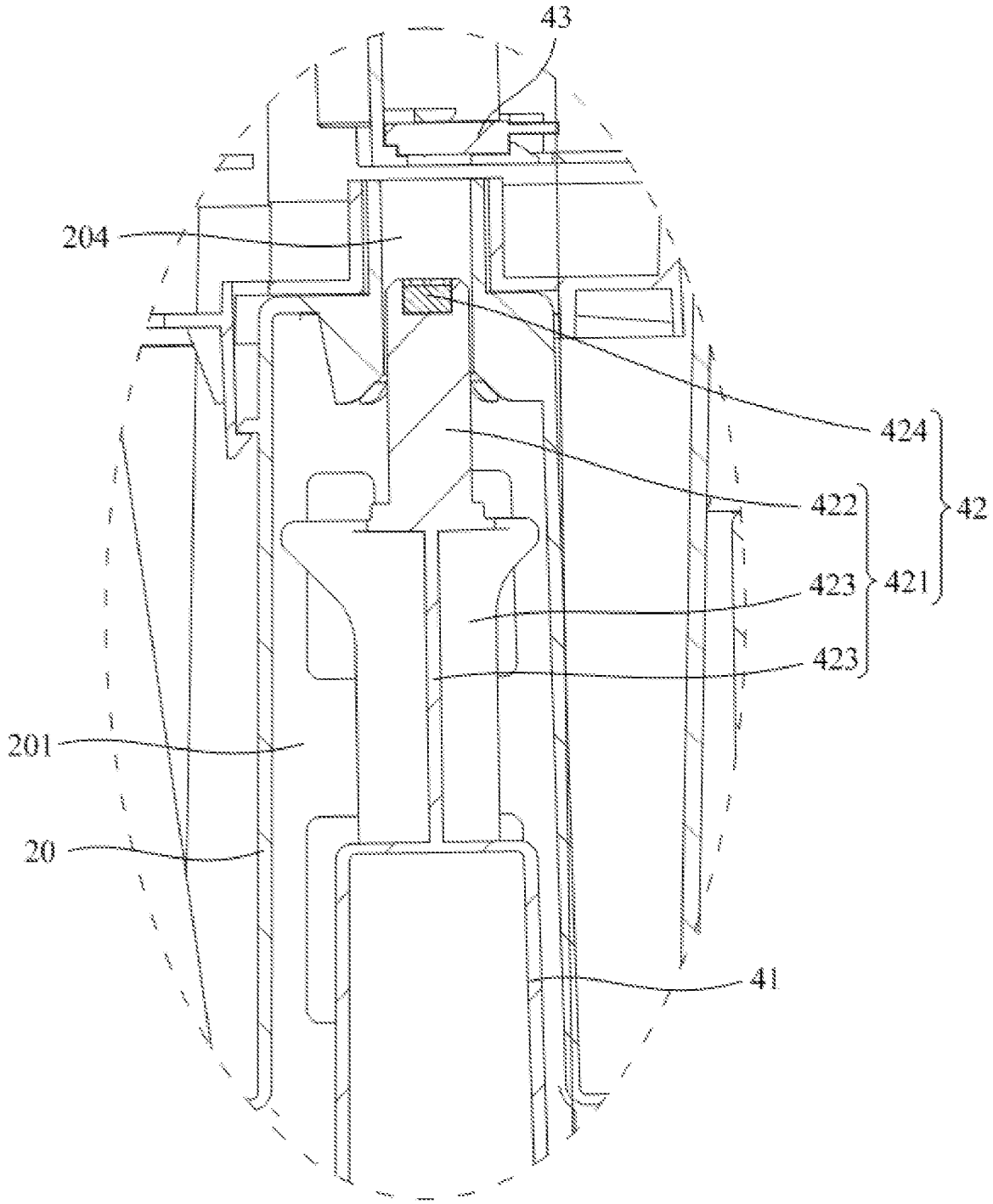
FIG. 6 is an enlarged view of A in FIG. 5.

In an embodiment according to the present application, referring to FIG. 1 to FIG. 3, the dehumidifier includes a middle partition plate 30, a water tank 10, a mounting bracket 20, a liquid level detector 40 and a water pump assembly. The water tank 10 is provided at one side of the middle partition plate 30. An outer surface of the mounting bracket 20 is provided with a fixation structure 22. The liquid level detector 40 is provided at the mounting bracket 20. The water pump assembly includes a suction pipe 51 provided at the fixation structure 22, and a water inlet end of the suction pipe 51 is provided at a bottom of the water tank 10.

In the embodiment, the mounting bracket 20 is provided in the water tank 10, and the water pump assembly is configured to discharge the water in the water tank 10 to the outside of the dehumidifier. Specifically, the water pump assembly further includes a water pump 52 and a drainage pipe 56, the water inlet end of the water pump 52 communicates with the suction pipe 51, the water outlet end of the water pump 52 communicates with the drainage pipe 56, and the drainage pipe 56 is configured to discharge water to the outside of the dehumidifier. The dehumidifier further includes a controller, the liquid level detector 40 and the water pump assembly are both electrically connected to the controller, so that when the liquid level detector 40 detects that the water in the water tank 10 reaches the preset water level, the water level signal can be transmitted to the controller, and then the controller controls the water pump assembly to pump water to discharge the water in the water tank 10. Certainly, in other embodiments, the liquid level detector 40 can also be electrically connected to an alarm to remind the user by the alarm, and the user manually starts the water pump assembly to pump water.

The preset water level can be located at the high water level of the water tank 10, that is, the preset water level is located at the upper end of the water tank 10. When the water in the water tank 10 reaches the preset water level, it means that the water tank 10 is about to be full of water, at this time, the water in the water tank 10 can be discharged by starting the water pump assembly. The preset water level can be located at the low water level of the water tank 10, that is, the preset water level is located at the bottom of the water tank 10. When the water in the water tank 10 reaches the preset water level, the water in the water tank 10 at least covers the water inlet 202 of the suction pipe 51, at this time, the water in the water tank 10 can be discharged by starting the water pump assembly, thus avoiding the situation where the water pump assembly is started when there is no water or too much water in the water tank 10.

The technical solution according to the present application is to provide a mounting bracket 20, a liquid level detector 40 and a water pump assembly on the dehumidifier, and install the liquid level detector 40 and the suction pipe 51 of the water pump assembly at the mounting bracket 20, thus making the water inlet end of the suction pipe 51 be provided at the bottom of the water tank 10. In this way, the water level in the water tank 10 can be detected by the liquid level detector 40, and then the water pump assembly can be started or shut down according to the water level in the water tank 10, thus using the water pump assembly to automatically drain the water in the water tank 10, which greatly facilitates the drainage of the water tank 10, avoids the need for users to pour water more frequently during the dehumidification process, and reduces the number of times the user pours water. Compared with the method where the suction pipe 51 and the liquid level detector 40 each have an mounting rack, in this solution, the liquid level detector 40 and the suction pipe 51 of the water pump assembly are both provided at the mounting bracket 20, which can reduce the number of parts of the dehumidifier and improve the compact structure of the dehumidifier. Moreover, the liquid level detector 40 can be configured to determine that there is water in the water tank 10 before starting the water pump assembly, which can prevent the water pump assembly from being started when there is no water or too much water in the water tank 10, which is beneficial to extending the life of the water pump assembly.

Referring to FIG. 4 to FIG. 9, in an embodiment, the mounting bracket 20 is provided with an accommodation cavity 201 and a water inlet 202 communicating with the accommodation cavity 201, the water inlet 202 is provided at a bottom of the mounting bracket 20, the liquid level detector 40 includes a floater part 41, a trigger part 42 and a detection switch 43, the floater part 41 is movably provided at the accommodation cavity 201, the trigger part 42 is connected to the floater part 41, the detection switch 43 is provided at intervals above the trigger part 42, and the detection switch 43 triggers the detection switch when the floater part 41 floats upward under the action of water. Specifically, the water inlet 202 is provided at the bottom surface of the mounting bracket 20. In an embodiment, the water inlet 202 is provided as an opening 412 to simplify the structure of the mounting bracket 20. Under the action of gravity, the floater part 41 can at least move down to the water inlet 202 to ensure that water can contact the floater part 41 when water enters from the water inlet 202. The detection switch 43 can be provided on the mounting bracket 20 or on the middle partition plate 30 of the dehumidifier, as long as the detection switch 43 is provided at intervals above the trigger part 42, and the detection switch 43 can trigger the detection switch when the floater part 41 floats upward under the action of water. Certainly, the water inlet 202 can also be provided at the side of the mounting bracket 20 and near the bottom.

When the liquid level detector 40 is used on the dehumidifier, the mounting bracket 20 can be placed at the bottom of the water tank 10, so that the floater part 41 is located at the bottom of the water tank 10. In this way, after the dehumidifier starts working, when the water in the water tank 10 gradually increases until the buoyancy force produced by the water on the floater part 41 is greater than the gravity of the floater part 41 and the gravity of the trigger part 42, the floater part 41 can drive the trigger part 42 to move upward, so that the detection switch 43 can be triggered by the trigger part 42. At this time, it can be determined that there is water in the water tank 10, when the dehumidifier is provided with a water pump assembly for draining the water tank 10, the water pump water pump 52 can be started to drain the water, thus avoiding the situation where the water pump 52 is started when there is no water in the water tank 10. In addition, the mounting bracket 20 can also be placed near the top of the water tank 10, so that the floater part 41 is located near the top of the water tank 10, when the water in the water tank 10 is almost full, the detection switch 43 can be triggered by the trigger part 42 to generate an alarm.

In an embodiment, the floater part 41 is integrally formed with the trigger part 42, thus reducing the assembly process of the floater part 41 and the trigger part 42, which is beneficial to improving assembly efficiency and can ensure reliable connection between the floater part 41 and the trigger part 42. Certainly, in other embodiments, the floater part 41 and the trigger part 42 are detachably connected.

In an embodiment, the floater part 41 is provided with a floater cavity 411 and an opening 412 communicating with the floater cavity 411, and the opening 412 is provided at a bottom of the floater part 41. Specifically, the opening 412 is provided at the bottom surface of the floater part 41, that is, the opening 412 is placed downward. After the liquid level detector 40 is installed at the water tank 10 of the dehumidifier, when the water in the water tank 10 reaches the opening 412, the water can seal off the opening 412, causing the floater cavity 411 to form a complete sealed cavity, at this time, the floater cavity 411 is filled with gas, and the floater part 41 floats when the water surface rises to a point where the buoyancy force is greater than gravity. In this way, when the opening 412 is provided at the bottom of the floater part 41, the floater cavity 411 can be easily formed. Moreover, there is no need to provide an additional cover plate at the opening 412, thus, it can reduce the number of parts and the assembly process of the floater part 41, and also reduce the overall weight of the floater part 41, which is beneficial to improving the floating speed of floater part 41. Certainly, in other embodiments, the floater cavity 411 may also be a sealed cavity; or the floater part 41 may be made of foam material.

In an embodiment, the floater part 41 is provided with a plurality of floating cavities 411, and the floater part 41 is provided with an opening 412 corresponding to each floater cavity 411. Specifically, at least two floating cavities 411 are provided, two adjacent floating cavities 411 are separated by partition plate, and the openings 412 of each floater cavity 411 are provided at the same horizontal plane. By providing the plurality of floating cavities 411, the buoyancy of the floater part 41 can be increased. Moreover, compared with the case of providing one large cavity, separating multiple floating cavities can make the structural strength of the floater part 41 higher, thus reducing the possibility of deformation of the floater part, and ensuring the structural reliability of the floater part 41. Certainly, in other embodiments, the floater part 41 may also be provided with only one floater cavity 411.

In an embodiment, one of the floater part 41 and a cavity wall of the accommodation cavity 201 is provided with a sliding convex rib 413 slidingly abutted against the other of the floater part 41 and the cavity wall of the accommodation cavity 201, and the sliding convex rib 413 is configured to extend along an up and down direction. Specifically, a sliding convex rib 413 may be provided at the cavity wall of the accommodation cavity 201, and the sliding convex rib 413 is in sliding contact with the outer side surface of the floater part 41. A sliding convex rib 413 may also be provided at the outer side surface of the floater part 41, and the sliding convex rib 413 is in sliding contact with the cavity wall of the accommodation cavity 201. In this way, the contact area between the cavity wall of the accommodation cavity 201 and the floater part 41 can be reduced, that is, the friction between the cavity wall of the accommodation cavity 201 and the floater part 41 can be reduced, and the resistance of the floater part 41 when it moves upward in the accommodation cavity 201 can be reduced, thus making it easier for the floater part 41 to move upward in the accommodation cavity 201, thereby increasing the floating speed of the floater part 41. Certainly, in other embodiments, the sliding convex rib 413 may not be provided.

In an embodiment, a plurality of sliding convex ribs 413 are provided, and the plurality of sliding convex ribs 413 are provided at intervals in the circumferential direction of the floater part 41. Specifically, sliding convex ribs 413 are provided around the floater part 41, so that all positions in the circumferential direction of the floater part 41 can be slidingly contacted by sliding convex ribs 413, thus avoiding the situation where the outer side surface of the floater part 41 is in contact with the cavity wall surface of the accommodation cavity 201.

In an embodiment, the mounting bracket 20 is further provided with a positioning hole 204 communicating with the accommodation cavity 201, the trigger part 42 includes a connection rod part 421 and a trigger member 424, the connection rod part 421 is connected to the floater part 41, the trigger member 424 is provided at an upper end of the connection rod part 421, and the connection rod part 421 is slidingly provided in the positioning hole 204. Specifically, the trigger member 424 is configured to trigger the detection switch 43, the positioning hole 204 extends along the up and down direction, and the connection rod part 421 can slide in the positioning hole 204 along the up and down direction. With this arrangement, the positioning hole 204 can be configured for positioning and installation of the connection rod part 421, and the positioning hole 204 can also be configured to limit the deflection of the connection rod part 421 during the up and down movement, thus ensuring the movement stability of the connection rod part 421. Certainly, in other embodiments, the mounting bracket 20 may also be provided with a guide column extending along the up and down direction, and the connection rod part 421 is provided with a guide hole for slidingly matching the guide column.

In an embodiment, the trigger member 424 is a magnet, and the detection switch 43 is a magnetic switch; or, the trigger member 424 is a light blocking piece or a reflective piece, and the detection switch 43 is a laser sensor; or, the trigger member 424 is a trigger head, and the detection switch 43 is a tact switch. Specifically, when the trigger member 424 is a trigger head and the detection switch 43 is a tact switch, the trigger member 424 can trigger the detection switch 43 by directly touching the detection switch 43. When the trigger member 424 is a magnet and the detection switch 43 is a magnetic switch, the detection switch 43 can be triggered only when the trigger member 424 moves up to the preset position with the floater part 41, in this way, the trigger member 424 does not need to be in contact with the detection switch 43, so the detection switch 43 can be provided to be sealed and the risk of water intrusion in the detection switch 43 is reduced. When the trigger member 424 is a light blocking piece or a reflective piece and the detection switch 43 is a laser sensor, similarly, the detection switch 43 can be triggered only when the trigger member 424 moves up to the preset position with the floater part 41, in this way, the trigger member 424 does not need to be in contact with the detection switch 43, so the detection switch 43 can be provided to be sealed and the risk of water intrusion in the detection switch 43 is reduced.

In an embodiment, the connection rod part 421 includes a positioning column 422 and a plurality of connection plates 423, each connection plate 423 is provided with a connecting side edge extending along the up and down direction, the connecting side edge of each connection plate 423 is connected to each other, each connection plate 423 is connected to the floater part 41, the positioning column 422 is connected to the connection point at the upper end of each connection plate 423, and the positioning column 422 is slidingly provided in the positioning hole 204. Specifically, at least two connection plates 423 are provided, two adjacent connection plates 423 are provided at an included angle, that is, the positions between two adjacent connection plates 423 are provided in a gap. Compared with the connection rod part 421 having a solid columnar structure, in this way, the weight of the connection rod part 421 can be reduced under the condition of ensuring that the connection rod part 421 has sufficient structural strength, thus making it easier for the floater part 41 to move upward and increasing the floating speed of the floater part 41. In an embodiment, the floater part 41 is integrally formed with the connection rod part 421.

Referring to FIG. 8 to FIG. 11, in an embodiment, a cavity wall of the accommodation cavity 201 is provided with a limit hole 203, the side of the floater part 41 is provided with a limit protrusion 414, the limit protrusion 414 extends into the limit hole 203 to limit the movement of the floater part 41 toward the outside of the accommodation cavity 201. Specifically, the size of the limit protrusion 414 is smaller than the size of the limit hole 203. When the floater part 41 is in a waterless environment, under the action of gravity, the limit protrusion 414 abuts against the lower edge of the limit hole 203, and the upper edge of the limit protrusion 414 and the upper edge of the limit hole 203 are provided at intervals. When the floater part 41 floats upward under the action of water, the limit protrusion 414 can move upward in the limit hole 203. By providing a limit protrusion 414 at the side of the floater part 41, when the limit protrusion 414 extends into the limit hole 203 in the cavity wall of the accommodation cavity 201, the floater part 41 can be prevented from detaching from the accommodation cavity 201, and the floater part 41, the trigger part 42 and the mounting bracket 20 can be assembled into an integral component, making it easy to install in the water tank of the dehumidifier. Certainly, in other embodiments, a limiting flange may also be provided at the water inlet 202 to limit the movement of the floater part 41 toward the outside of the accommodation cavity 201.

Figure 10:
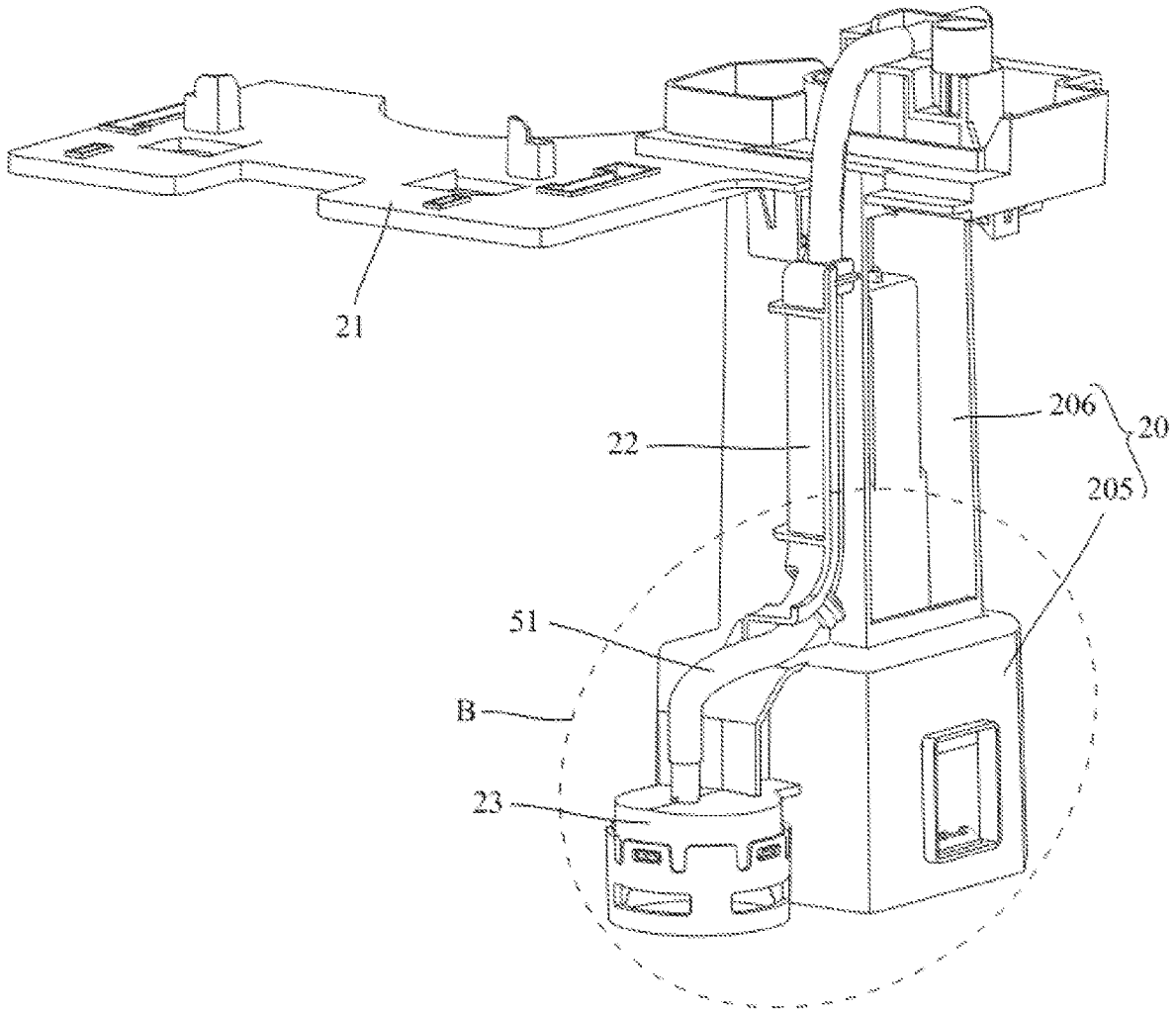
FIG. 10 is a schematic structural diagram of the mounting bracket and the liquid level detector in FIG. 7 from another perspective.
Figure 11:
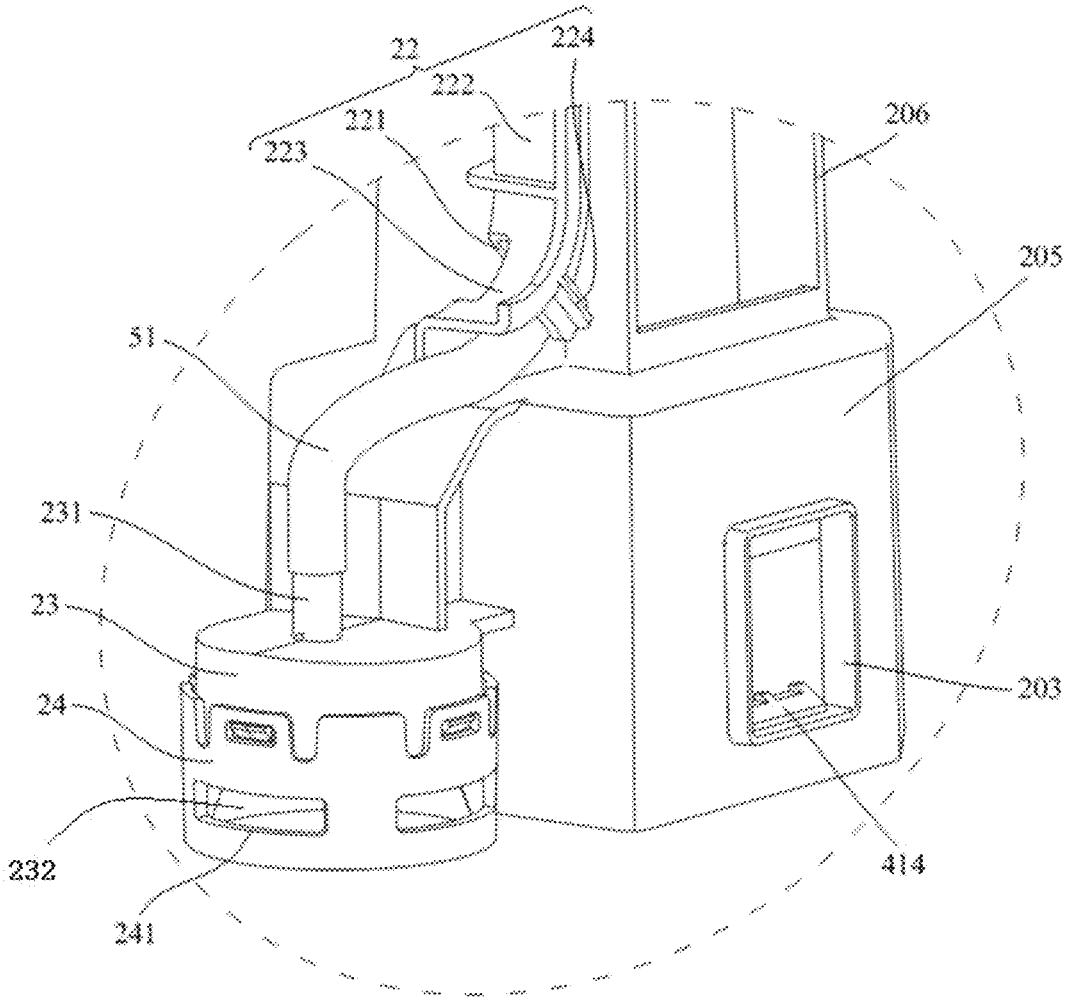
FIG. 11 is an enlarged view of B in FIG. 10.

Referring to FIG. 10 and FIG. 11, in an embodiment, the fixation structure 22 includes a connection part 221 and a shield part 222, the connection part 221 is connected to the outer surface of the mounting bracket 20, the shield part 222 is connected to the connection part 221 and is spaced apart from the outer surface of the mounting bracket 20, and the suction pipe 51 is clamped between the shield part 222 and the outer surface of the mounting bracket 20. Specifically, the fixation structure 22 further includes a limiting convex rib 224, the limiting convex rib 224 is provided at the side of the shield part 222 facing the outer surface of the mounting bracket 20, the limiting convex rib 224 and the connection part 221 are provided at intervals, the suction pipe 51 is provided between the limiting convex rib 224 and the connection part 221, that is, the limiting convex rib 224 can limit the movement of the suction pipe 51 away from the connection part 221, thus ensuring that the suction pipe 51 is stably fixed on the mounting bracket 20. The fixation structure 22 is integrally formed on the mounting bracket 20, that is, the connection part 221, the shield part 222 and the limiting convex rib 224 are integrally formed. Compared with the method of fixing the suction pipe 51 to the mounting bracket 20 by clamps or screws, in this way, it can reduce the number of parts, thereby reducing the assembly process and improving assembly efficiency. Certainly, in other embodiments, the distance between the shield part 222 and the outer surface of the mounting bracket 20 can also be made smaller than the outer diameter of the suction pipe 51, so that the suction pipe 51 is clamped between the shield part 222 and the outer surface of the mounting bracket 20.

In an embodiment, the mounting bracket 20 includes a first mounting section 205 and a second mounting section 206 connected to an upper end of the first mounting section 205, the water inlet 202 is provided at the bottom of the first mounting section 205, the interiors of the first mounting section 205 and the second mounting section 206 form an accommodation cavity 201 together, the floater part 41 is provided in the first mounting section 205, the trigger part 42 (connection rod part 421) is provided in the second mounting section 206, and the circumferential size of the second mounting section 206 is smaller than the circumferential size of the first mounting section. In order to ensure that the floater part 41 has greater buoyancy and reduce the weight of the trigger part 42 (connection rod part 421) at the same time, the floater part 41 can be provided larger, while the size of the trigger part 42 (connection rod part 421) is provided smaller. By making the circumferential size of the second mounting section 206 smaller than the circumferential size of the first mounting section, the gap between the second mounting section 206 and the trigger part 42 (connection rod part 421) can be smaller, which is beneficial to reducing the overall size of the mounting bracket 20 and improving the structural compactness of the dehumidification device. Moreover, when the mounting bracket 20 is provided in the water tank 10, the space occupied by the mounting bracket 20 in the water tank 10 can be reduced, so that the water tank 10 can accommodate more water.

In an embodiment, the shield part 222 is provided at the second mounting section 206 and extends along the up and down direction, the lower end of the shield part 222 is provided with a transition section 223, the transition section 223 is located at the connection between the first mounting section 205 and the second mounting section 206, and the suction pipe 51 is located between the transition section 223 and the surface of the mounting bracket 20. In this way, the part of the suction pipe 51 located at the connection between the first mounting section 205 and the second mounting section 206 can be constrained by the transition section 223, which allows the suction pipe 51 to fit better on the surface of the mounting bracket 20, thus making the assembled component structure of the mounting bracket 20 and the suction pipe 51 more compact. In an embodiment, the transition section 223 is in a convex arc shape protruding toward the connection between the first mounting section 205 and the second mounting section 206, which is beneficial to the smooth transition of the part of the suction pipe 51 located at the connection between the first mounting section 205 and the second mounting section 206.

In an embodiment, the dehumidifier further includes a filter bracket 23, the filter bracket 23 is provided with a filter cavity 232 and a water filter joint 231 communicating with the filter cavity 232, and a lower end of the suction pipe 51 is connected to the water filter joint 231. In this embodiment, the filter bracket 23 is connected to the bottom of the mounting bracket 20. The filter bracket 23 is provided with a downward-facing mounting opening. The dehumidifier further includes a filter screen and a filter cover 24. The filter screen is provided in the filter cavity 232, and the filter cover 24 covers the mounting opening to limit the filter screen in the filter cavity 232, the filter cover 24 is provided with a filter water inlet 241 communicating with the filter cavity 232. In this way, impurities such as dust particles in the water in the water tank 10 can be filtered, thus reducing the situation where impurities enter the water pump assembly and cause blockage of the water pump assembly. Moreover, by connecting the filter bracket 23 to the mounting bracket 20, the filter bracket 23 can be firmly fixed, thus avoiding the situation where filter bracket 23 and suction pipe 51 shake. Certainly, in other embodiments, the filter screen can also be stuck on the cavity wall of the filter cavity, so that the filter cover 24 does not need to be provided. In addition, in other embodiments, the filter bracket 23 and the mounting bracket 20 are provided separately.

In an embodiment, the fixation structure 22 is integrally formed with the mounting bracket 20. Specifically, the connection part 221, the shield part 222, the limiting convex rib 224, the transition section 223 and the filter bracket filter bracket 23 are integrally formed on the mounting bracket 20, which facilitates molding, thus reducing the assembly process of the fixation structure 22 and the mounting bracket 20, improving assembly efficiency, and also ensuring reliable connection between the fixation structure 22 and the mounting bracket 20. Certainly, in other embodiments, the fixation structure 22 can also be clamped or connected to the mounting bracket 20 by screws.

Referring to FIG. 1, FIG. 2, FIG. 3, FIG. 12 and FIG. 13, in an embodiment, the water pump assembly further includes a first joint 53 and a second joint 54, the second joint 54 is provided at the middle partition plate 30, the first joint 53 is provided at the mounting bracket 20, one end of the first joint 53 is connected to the suction pipe 51, and another end of the first joint 53 is in insertion connection with the second joint 54. When the first joint 53 is in insertion connection with the second joint 54, the first joint 53 and the second joint 54 can be communicated with, that is, the water flowing from the suction pipe 51 to the first joint 53 can flow to the second joint 54 and be discharged from the second joint 54. By inserting and mating the first joint 53 with the second joint 54, the connection between the first joint 53 and the second joint 54 can be facilitated during the process of disassembly and assembly the water tank 10. Moreover, by directly providing the second joint 54 on the middle partition plate 30, there is no need to provide an additional mounting base, thus eliminating the need for a mounting base, reducing the cost of the dehumidifier and improving the assembly efficiency of the dehumidifier. The first joint 53 can be inserted in the second joint 54, or the second joint 54 can be inserted in the first joint 53.

In an embodiment, the dehumidifier further includes a housing, the middle partition plate 30 is provided in the housing, the housing is provided with a water tank assembly port for disassembling and assembling the water tank 10, and the second joint 54 is provided toward the water tank assembly port. That is, one end of the second joint 54 in insertion connection with the first joint 53 faces toward the water tank assembly port, so that the direction in which the water tank 10 is pushed into the housing is consistent with the insertion direction of the first joint 53 and the second joint 54, therefore, in the process of pushing the water tank 10 from the water tank assembly port, the first joint 53 and the second joint 54 can be gradually connected, and when the water tank 10 is installed in place, the first joint 53 and the second joint 54 are also inserted in place. In this way, there is no need to additionally manually connect the first joint 53 and the second joint 54, which facilitates the disassembly and assembly of the water tank 10. Certainly, in other embodiments, the second joint 54 can also extend downward, and the first joint 53 can extend upward, and the water tank 10 can move upward after being pushed into the housing, so that the first joint 53 and the second joint 54 are inserted one to another.

Figure 12:
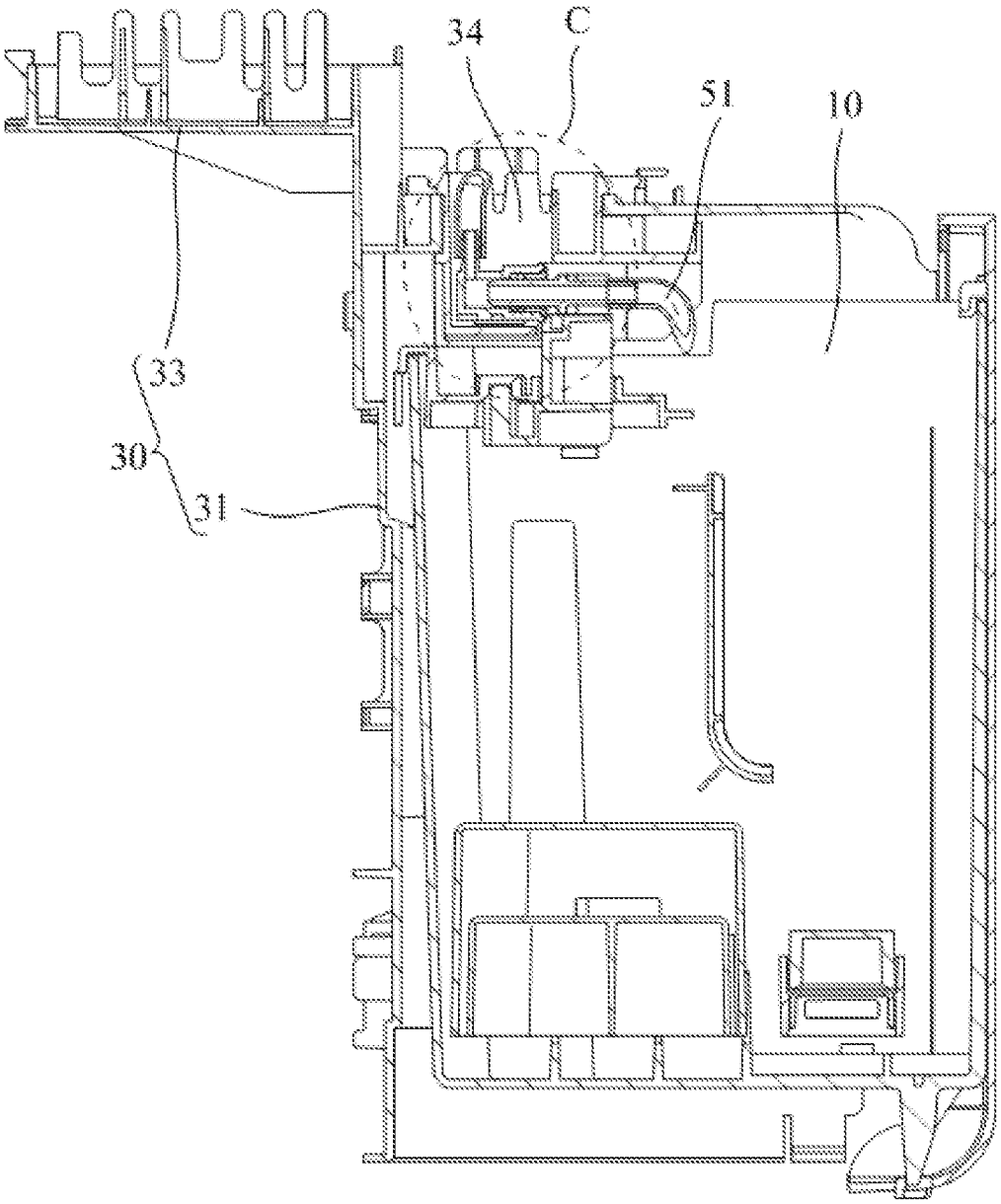
FIG. 12 is a cross-sectional view at Z-Z in FIG. 4.
Figure 13:
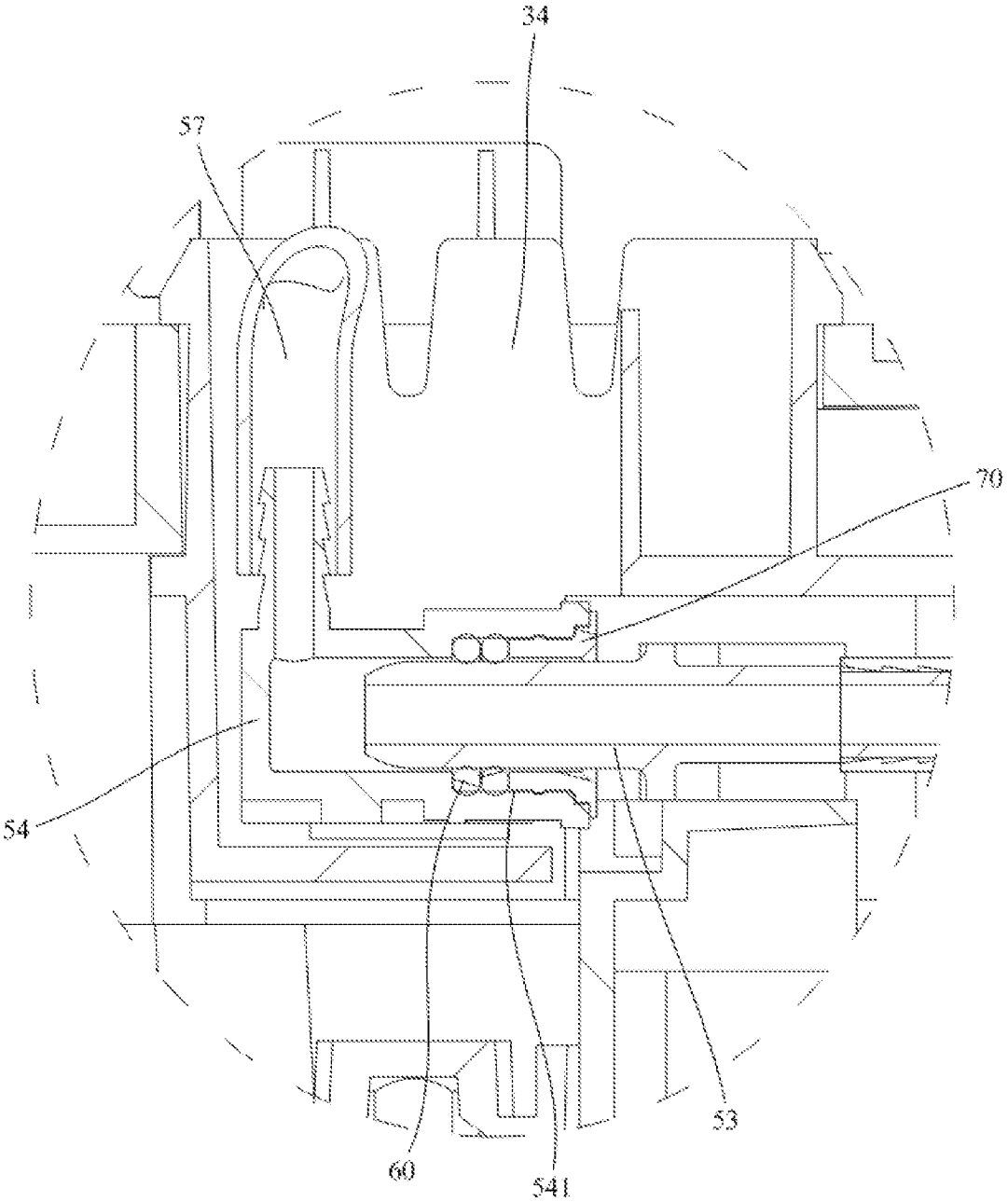
FIG. 13 is an enlarged view of C in FIG. 12.
Figure 14:
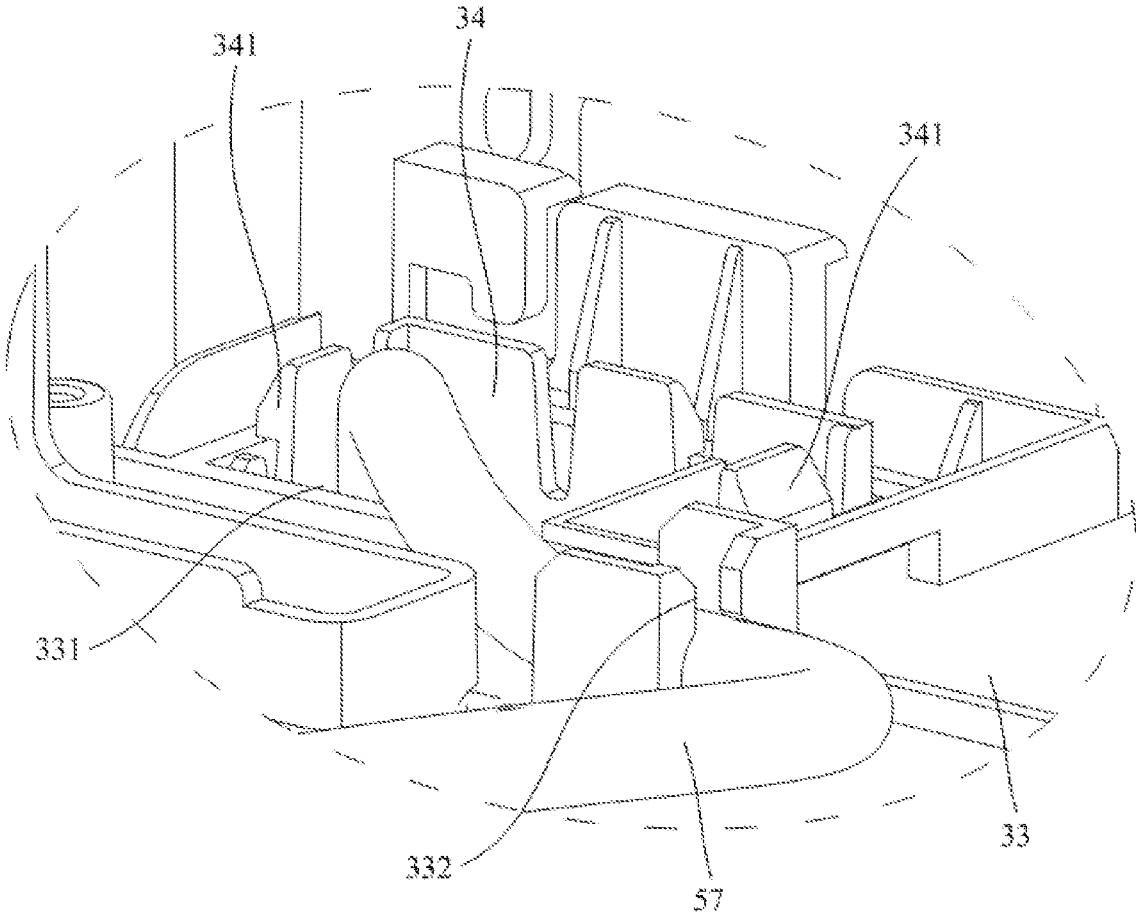
FIG. 14 is an enlarged view of D in FIG. 3.
Figure 15:
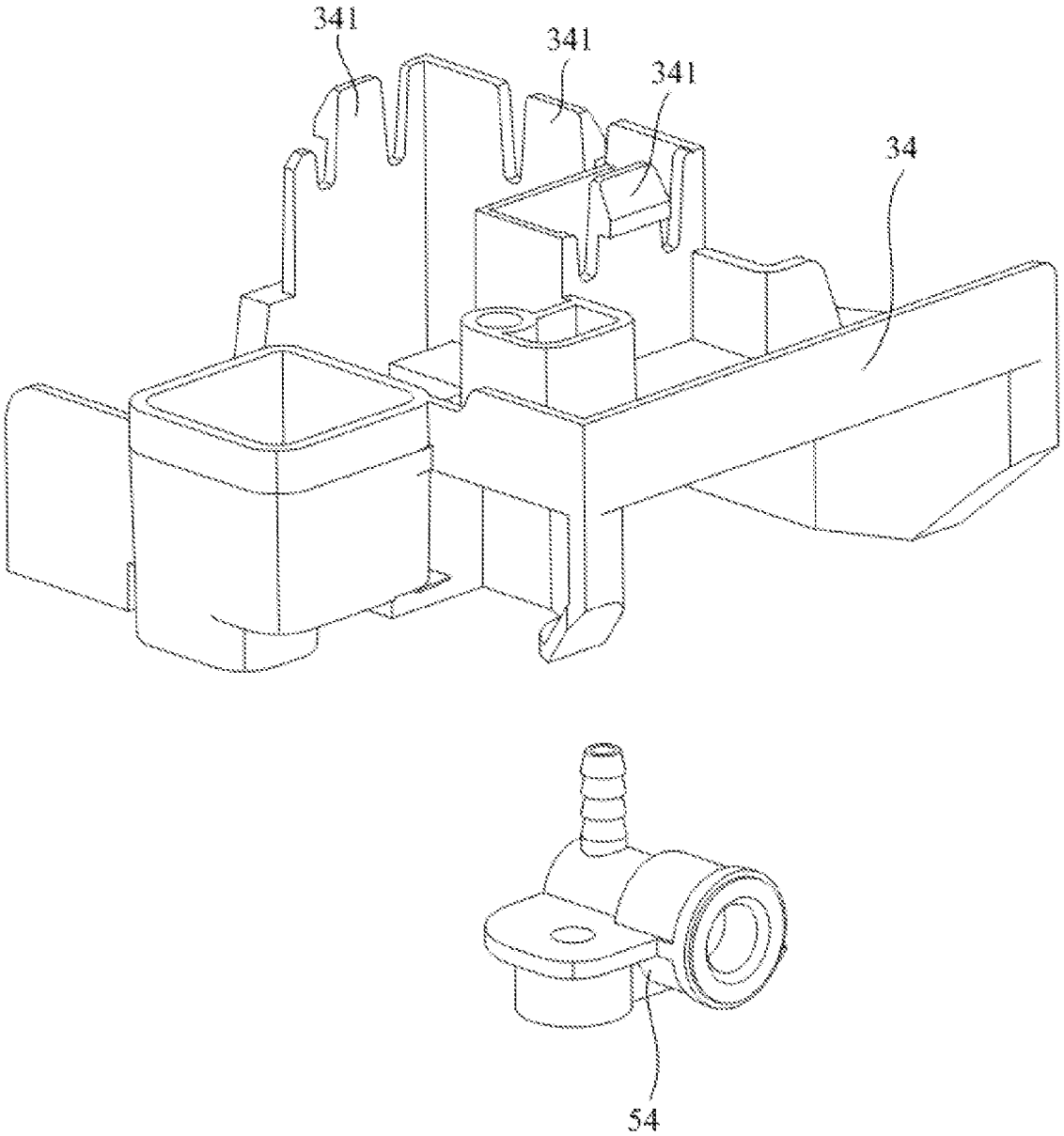
FIG. 15 is an exploded view of the fixation bracket and the second joint in FIG. 3.

Referring to FIG. 12 and FIG. 13, in an embodiment, a sealing member 60 is provided between the first joint 53 and the second joint 54. In this way, the gap between the first joint 53 and the second joint 54 can be sealed by the sealing member 60, thereby reducing the risk of water leakage between the first joint 53 and the second joint 54. The sealing member 60 may be but is not limited to a sealing ring.

In an embodiment, the second joint 54 is sleeved on an outside of the first joint 53, a sealing groove 541 is provided at an inside of the second joint 54 or an outside of the first joint 53, the sealing member 60 is limited to the sealing groove 541, and the sealing member 60 partially protrudes outside the sealing groove 541. That is, the first joint 53 is inserted in the second joint 54, in this embodiment, a sealing groove 541 is provided inside the second joint 54, the sealing groove 541 is annular and is provided around the outer periphery of the first joint 53. The sealing member 60 is a sealing ring. When the sealing member 60 is installed into the sealing groove 541, the sealing member 60 partially protrudes from the inner side surface of the second joint 54. When the first joint 53 is inserted in the second joint 54, the sealing member 60 can be sleeved on the outer periphery of the first joint 53 to seal the gap between the first joint 53 and the second joint 54. In this way, the sealing member 60 can be limited by the sealing groove 541, thereby reducing the risk of the sealing member 60 falling during the insertion and extraction process of the first joint 53 and the second joint 54.

In an embodiment, an anti-falling member 70 is provided at an inner side of the second joint 54, and the anti-falling member 70 is provided between the sealing member 60 and the sealing groove 541, which can prevent the sealing member 60 from coming out of the second joint 54, and further reduce the risk of the sealing member 60 falling during the insertion and extraction process of the first joint 53 and the second joint 54.

In another embodiment, the first joint 53 is sleeved on an outside of the second joint 54, a sealing groove 541 is provided at an inside of the first joint 53 or an outside of the second joint 54, the sealing member 60 is limited to the sealing groove 541, and the sealing member 60 partially protrudes outside the sealing groove 541. In this way, the sealing member 60 can be limited by the sealing groove 541, thereby reducing the risk of the sealing member 60 falling during the insertion and extraction process of the first joint 53 and the second joint 54.

Referring to FIG. 3, FIG. 12, FIG. 13 and FIG. 14, in an embodiment, the middle partition plate 30 includes a support plate 31 and a mounting plate 33 connected to an upper end of the support plate 31, the water tank 10 is provided at one side of the support plate 31, the mounting plate 33 is provided above the water tank 10, the mounting plate 33 is provided with a mounting through hole 331, and the second joint 54 is provided at the mounting through hole 331. Specifically, the water pump assembly further includes a first connection pipe 57, the first connection pipe 57 passes through the mounting through hole 331 and is connected to the second joint 54, that is, one end of the second joint 54 is in insertion connection with the first joint 53, and another end of the second joint 54 is connected to the first connection pipe 57. In this way, when the mounting through hole 331 is provided on the mounting plate 33, the first connection pipe 57 of the water pump assembly for connecting the second joint 54 can be passed through, thus avoiding the situation where the first connection pipe 57 is passed around the edge of the mounting plate 33 and then connected to the second joint 54, reducing the length of the first connection pipe 57, therefore, the space occupied by the first connection pipe 57 in the dehumidifier can be reduced, making the internal structure of the dehumidifier more compact. Certainly, in other embodiments, the second joint 54 can also be installed at the support plate 31.

Referring to FIG. 3, FIG. 12 to FIG. 15, in an embodiment, the middle partition plate 30 further includes a fixation bracket 34, the fixation bracket 34 is provided at the mounting through hole 331, and the second joint 54 is provided at the fixation bracket 34. That is, the second joint 54 can be provided at the fixation bracket 34 firstly, and then the fixation bracket 34 can be provided at the mounting through hole 331. In this way, when the second joint 54 is firstly provided at the fixation bracket 34, the reliability of the connection between the second joint 54 and the fixation bracket 34 can be better ensured, moreover, the connection area between the fixation bracket 34 and the mounting plate 33 can be larger, and more connection positions are provided, which can better ensure the reliability of the connection between the fixation bracket 34 and the mounting plate 33, that is, the assembly stability of the second joint 54 is improved, thereby reducing the risk of the second joint 54 loosening or even falling during the insertion and extraction process of the first joint 53 and the second joint 54. Moreover, during the insertion and extraction process of the first joint 53 and the second joint 54, the force on the fixation bracket 34 and the mounting plate 33 is distributed widely and evenly, thus reducing the risk of rupture of the mounting plate 33 due to concentrated stress on the fixation bracket 34 and the mounting plate 33. Certainly, in other embodiments, the second joint 54 can also be directly fixed on the mounting plate 33.

In an embodiment, the fixation bracket 34 is provided with a snap 341 extending upward, the snap 341 is snapped at the edge of the mounting through hole 331, which eliminates the need for screw fixation, thus facilitating disassembly and assembly, and helping improve assembly efficiency. Certainly, in other embodiments, the fixation bracket 34 can also be fixed to the mounting plate 33 by screws.

Referring to FIG. 3, FIG. 12 and FIG. 13, in an embodiment, the water pump assembly further includes a water pump 52, the water pump 52 is provided at the mounting plate 33, and a water inlet end of the water pump 52 is configured to communicate with the second joint 54. Specifically, the water pump 52 is provided at the upper surface of the mounting plate 33, the water inlet end of the water pump 52 is connected to the first connection pipe 57, that is, one end of the first connection pipe 57 is connected to the second joint 54, and another end of the first connection pipe 57 is connected to the water inlet end of the water pump 52. In this way, using the mounting plate 33 to install the water pump 52 can improve the space utilization on the mounting plate 33 and further improve the structural compactness of the dehumidifier. Moreover, when the water pump 52 is installed on the mounting plate 33, the length of the first connection pipe 57 can be reduced. Certainly, in other embodiments, the water pump 52 can also be provided at the support plate 31 or at the chassis of the dehumidifier.

In an embodiment, a fixation clip 332 is provided at the upper surface of the mounting plate 33, and the fixation clip 332 is provided adjacent to the edge of the mounting through hole 331, the first connection pipe 57 is clamped to the fixation clip 332. In this way, the first connection pipe 57 can better fit on the upper surface of the mounting plate 33, which is beneficial to improving the structural compactness of the upper side of the mounting plate 33.

Figure 16:
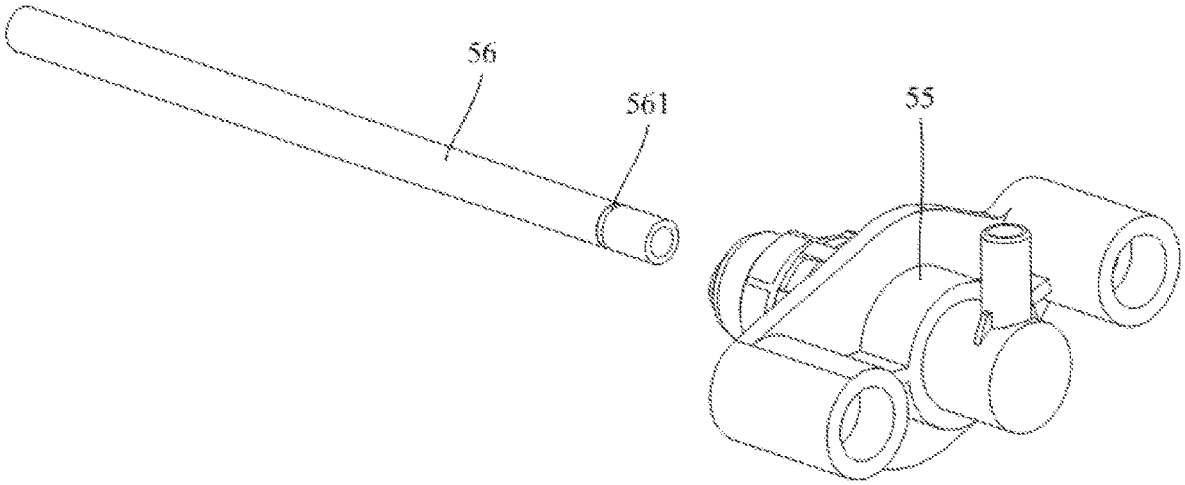
FIG. 16 is an exploded view of the drainage joint and the drainage pipe in FIG. 3.

Referring to FIG. 3 and FIG. 16, in an embodiment, the water pump assembly further includes a drainage joint 55 and a drainage pipe 56, one end of the drainage joint 55 communicates with the suction pipe 51, another end of the drainage joint 55 is for the drainage pipe 56 to be inserted in, one end of the drainage pipe 56 inserted in the drainage joint 55 is provided with a mark part 561, and the mark part 561 is configured to mark an insertion depth of the drainage pipe 56 and the drainage joint 55. Specifically, the water pump assembly further includes a second connection pipe 58, one end of the second connection pipe 58 is connected to the water outlet end of the water pump 52, and another end of the second connection pipe 58 is connected to the drainage joint 55, so that the drainage joint 55 communicates with the suction pipe 51. The mark part 561 is provided at the outer peripheral surface of the drainage pipe 56, and the mark part 561 is at least partially spaced from the end of the drainage pipe 56 (the end of the drainage pipe 56 inserted in the drainage joint 55). When one end of the drainage pipe 56 provided at the mark part 561 is inserted in the drainage joint 55, the insertion depth of the drainage pipe 56 can be determined by observing the positional relationship between the mark part 561 and the edge of the socket of the drainage joint 55. In this way, it can make it easier for the operator to determine the insertion depth of the drainage pipe 56 and the insert-in joint, that is, it can make it easier for the operator to determine whether the drainage pipe 56 is installed in place, thus reducing the risk that the drainage pipe 56 will fall off from the insert-in joint during the drainage process due to excessive insertion depth. The mark part 561 may be a scale, a groove, a protrusion or a label, etc.

Figure 7:
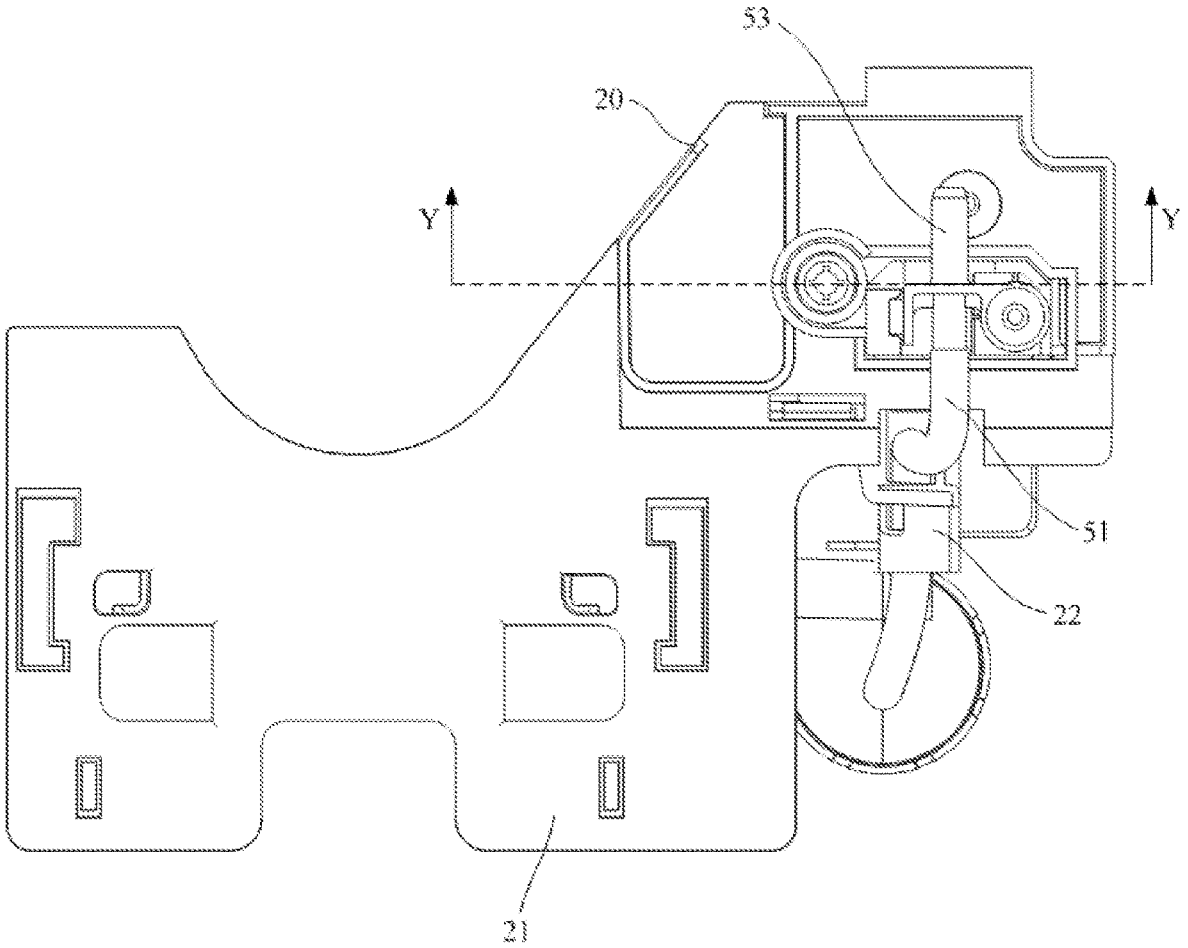
FIG. 7 is a schematic structural diagram of the mounting bracket and the liquid level detector in FIG. 5 viewed from top to bottom.
Figure 8:
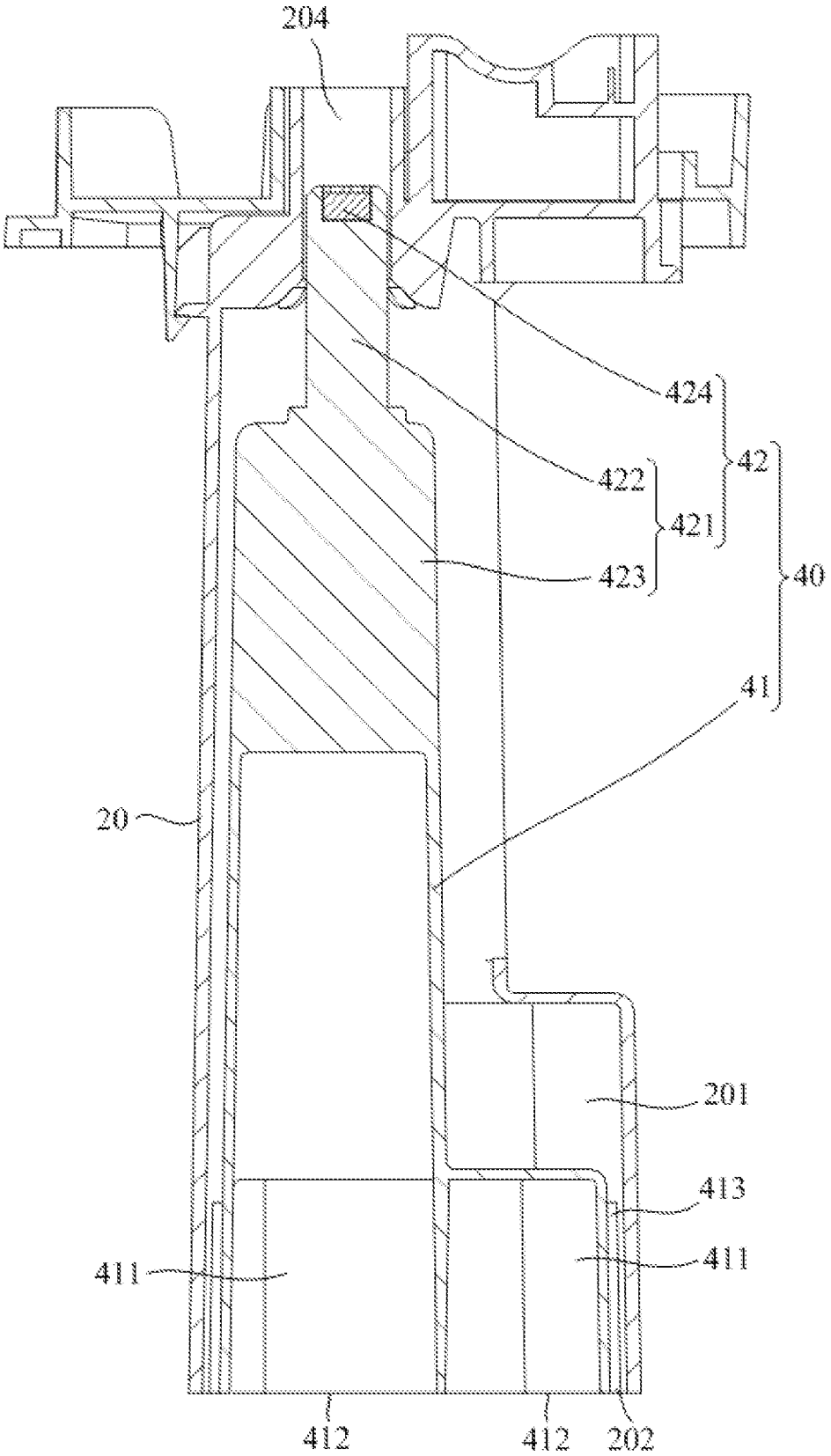
FIG. 8 is a cross-sectional view of Y-Y in FIG. 7.
Figure 9:
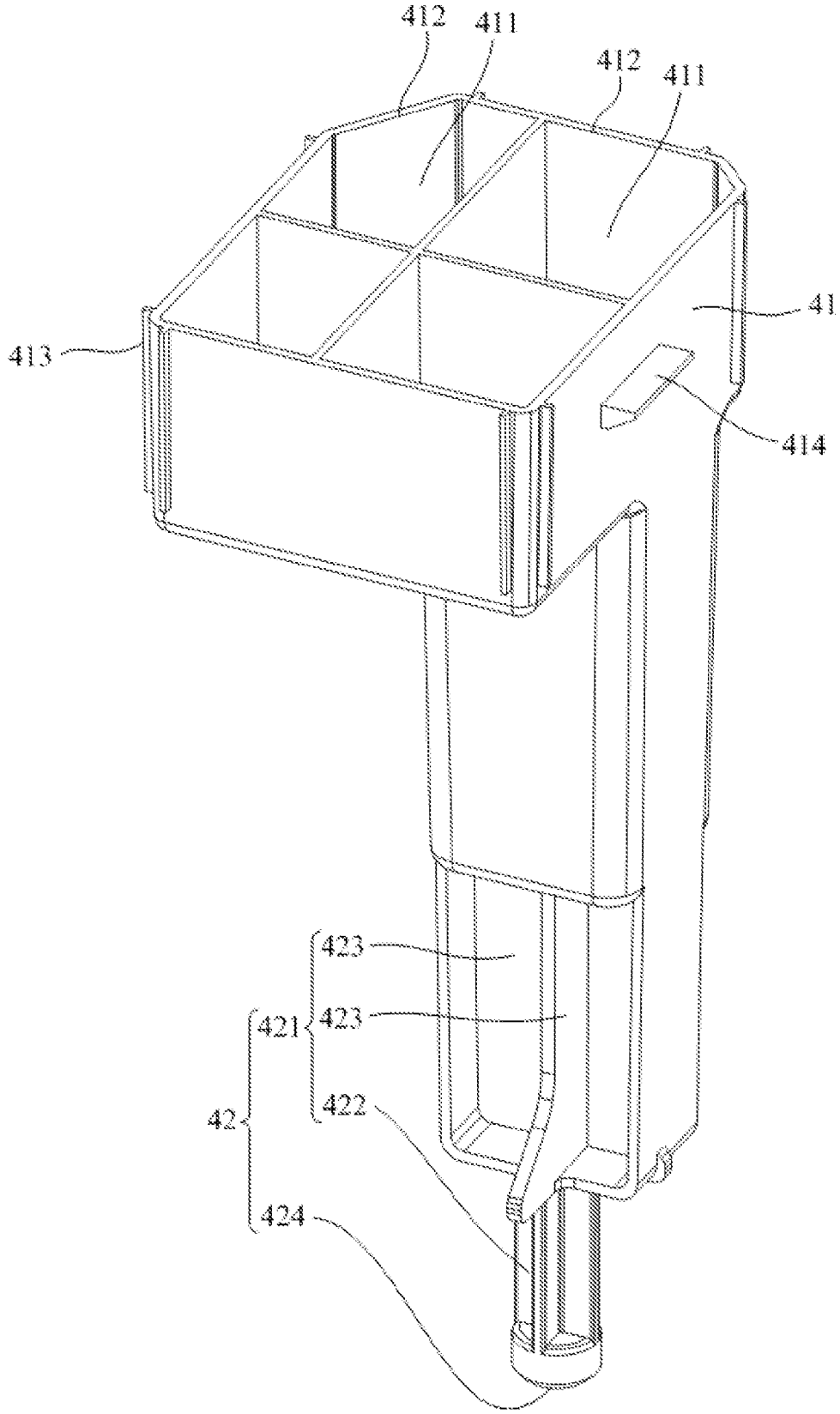
FIG. 9 is a schematic structural diagram of the floater part and the trigger part in FIG. 8 from another perspective.

Referring to FIG. 7 and FIG. 10, in an embodiment, the dehumidifier further includes a water tank cover 21, the water tank cover 21 is connected to an upper end of the mounting bracket 20, and the water tank cover 21 is configured to cover an opening of the water tank 10. In this way, the water tank cover 21 and the mounting bracket 20 are connected together. During installation, the water tank cover 21 and the mounting bracket 20 can be installed at the same time, which can improve the efficiency of the final assembly. In an embodiment, the water tank cover 21 and the mounting bracket 20 are integrally formed, which can reduce the assembly process of the water tank cover 21 and the mounting bracket 20.

Referring to FIG. 3 and FIG. 12, in an embodiment, the middle partition plate 30 is provided with a water receiving tray 32, the dehumidifier further includes a heat exchanger assembly, the heat exchanger assembly is provided on the water receiving tray 32, and the water receiving tray 32 is configured to receive the condensed water generated by the heat exchanger assembly. In this embodiment, the water receiving tray 32 is connected to the upper end of the support plate 31, and the mounting plate 33 and the water receiving tray 32 are respectively provided at two opposite sides of the support plate 31. The dehumidifier further includes a compressor connected to the heat exchanger assembly, the compressor is provided below the water receiving tray 32, and the water tank 10 is provided at the side of the support plate 31 away from the compressor. The heat exchanger assembly includes an evaporator and a condenser. The water vapor in the air is firstly condensed into water droplets by the evaporator, and the water vapor in the air is removed, and then the air after removing water vapor is heated and dried by the condenser to return the blown wind to normal temperature. Certainly, in other embodiments, the dehumidification device may also adopt dehumidification methods such as adsorption type.

The above are only some embodiments of the present application, and are not intended to limit the scope of the present application. Under the concept of the present application, any equivalent structure transformation made by using the description and accompanying drawings of the present application, or directly or indirectly applied in other related technical fields, is included within the scope of the present application.

What is claimed is:

1. A dehumidifier comprising:

a middle partition plate;

a water tank provided at one side of the middle partition plate;

a mounting bracket including a fixation structure provided at an outer surface of the mounting bracket;

a liquid level detector provided at the mounting bracket; and a water pump assembly including a suction pipe provided at the fixation structure, a water inlet end of the suction pipe being provided at a bottom of the water tank;

wherein:

the fixation structure includes:

a connection part connected to the outer surface of the mounting bracket; and a shield part connected to the connection part and spaced apart from the outer surface of the mounting bracket; and the suction pipe is clamped between the shield part and the outer surface of the mounting bracket.

2. The dehumidifier according to claim 1, further comprising:

a filter bracket, wherein the filter bracket is provided with a filter cavity and a water filter joint communicating with the filter cavity, and a lower end of the suction pipe is connected to the water filter joint.

3. The dehumidifier according to claim 1, wherein the fixation structure is integrally formed with the mounting bracket.

4. The dehumidifier according to claim 1, wherein:

the mounting bracket is provided with an accommodation cavity and a water inlet communicating with the accommodation cavity;

the water inlet is provided at a bottom of the mounting bracket; and the liquid level detector includes:

a floater part movably provided at the accommodation cavity;

a trigger part connected to the floater part; and a detection switch provided above the trigger part and configured to trigger the detection switch.

5. The dehumidifier according to claim 4, wherein the floater part is provided with a floater cavity and an opening communicating with the floater cavity, and the opening is provided at a bottom of the floater part.

6. The dehumidifier according to claim 4, wherein one of the floater part and a cavity wall of the accommodation cavity is provided with a sliding convex rib slidingly abutting against another of the floater part and the cavity wall of the accommodation cavity, and the sliding convex rib is configured to extend along an up and down direction.

7. The dehumidifier according to claim 4, wherein:

the mounting bracket is further provided with a positioning hole communicating with the accommodation cavity; and the trigger part includes:

a connection rod part slidingly provided in the positioning hole and connected to the floater part; and a trigger member provided at an upper end of the connection rod part.

8. The dehumidifier according to claim 1, wherein the water pump assembly further includes a first joint and a second joint, the second joint is provided at the middle partition plate, the first joint is provided at the mounting bracket, one end of the first joint is connected to the suction pipe, and another end of the first joint is in insertion connection with the second joint.

9. The dehumidifier according to claim 8, further comprising:

a housing;

wherein:

the middle partition plate is provided in the housing;

the housing is provided with a water tank assembly port for disassembling and assembling the water tank; and the second joint is provided toward the water tank assembly port.

10. The dehumidifier according to claim 8, wherein a sealing member is provided between the first joint and the second joint.

11. The dehumidifier according to claim 10, wherein:

the second joint is sleeved on an outside of the first joint, a sealing groove is provided at an inside of the second joint or an outside of the first joint, the sealing member is limited to the sealing groove, and the sealing member partially protrudes outside the sealing groove; or the first joint is sleeved on an outside of the second joint, a sealing groove is provided at an inside of the first joint or an outside of the second joint, the sealing member is limited to the sealing groove, and the sealing member partially protrudes outside the sealing groove.

12. The dehumidifier according to claim 8, wherein:

the middle partition plate includes a support plate and a mounting plate connected to an upper end of the support plate;

the water tank is provided at one side of the support plate;

the mounting plate is provided above the water tank and is provided with a mounting through hole; and the second joint is provided at the mounting through hole.

13. The dehumidifier according to claim 12, wherein the middle partition plate further includes a fixation bracket provided at the mounting through hole, and the second joint is provided at the fixation bracket.

14. The dehumidifier according to claim 12, wherein the water pump assembly further includes a water pump provided at the mounting plate, and a water inlet end of the water pump is configured to communicate with the second joint.

15. The dehumidifier according to claim 1, wherein the water pump assembly further includes a drainage joint and a drainage pipe, one end of the drainage joint communicates with the suction pipe, another end of the drainage joint is for the drainage pipe to be inserted in, one end of the drainage pipe inserted in the drainage joint is provided with a mark part, and the mark part is configured to mark an insertion depth of the drainage pipe and the drainage joint.

16. The dehumidifier according to claim 1, further comprising:

a water tank cover connected to an upper end of the mounting bracket, and configured to cover an opening of the water tank.

17. A dehumidifier comprising:

a middle partition plate;

a water tank provided at one side of the middle partition plate;

a mounting bracket including a fixation structure provided at an outer surface of the mounting bracket;

a liquid level detector provided at the mounting bracket; and a water pump assembly including a suction pipe provided at the fixation structure, a water inlet end of the suction pipe being provided at a bottom of the water tank;

wherein the water pump assembly further includes a first joint and a second joint, the second joint is provided at the middle partition plate, the first joint is provided at the mounting bracket, one end of the first joint is connected to the suction pipe, and another end of the first joint is in insertion connection with the second joint.

* * * * *